US006401466B1

(12) United States Patent
Olsen

(10) Patent No.: US 6,401,466 B1
(45) Date of Patent: Jun. 11, 2002

(54) DOOR MONITOR APPARATUS FOR INTERRUPTING AND RESTORING WALK-IN REFRIGERATION SYSTEM OPERATION AND ALARM MONITORING SYSTEM THEREFOR

(76) Inventor: Donald Olsen, 11 Larkspur Dr., Smithtown, NY (US) 11787

( * ) Notice: Subject to any disclaimer, the term of this patent is extended or adjusted under 35 U.S.C. 154(b) by 0 days.

(21) Appl. No.: 09/808,452

(22) Filed: Mar. 14, 2001

Related U.S. Application Data

(60) Provisional application No. 60/189,319, filed on Mar. 14, 2000.

(51) Int. Cl.[7] ..... F25B 49/02

(52) U.S. Cl. ..... 62/131; 62/180; 62/264

(58) Field of Search ..... 62/131, 125, 126, 62/127, 129, 130, 157, 158, 231, 264, 180, 186; 340/585

(56) References Cited

U.S. PATENT DOCUMENTS 4,707,684 A * 11/1987 Janke et al. ..... 62/131 X
5,289,162 A 2/1994 McDaniel
5,451,930 A 9/1995 McDaniel
5,682,756 A 11/1997 Lehmiller et al.
5,856,781 A * 1/1999 Michel et al. ..... 62/129 X
6,014,865 A * 1/2000 Kim et al. ..... 62/131 X
6,058,722 A * 5/2000 Choi ..... 62/186 X

* cited by examiner

*Primary Examiner*—Harry B. Tanner
(74) *Attorney, Agent, or Firm*—Hoffman & Baron, LLP

(57) ABSTRACT

An apparatus for monitoring, indicating and controlling conditions of a refrigeration system having a refrigerated compartment, a door for accessing the refrigerated compartment, an interior light source for illuminating the interior of the compartment and a fan and coolant valve arrangement for refrigerating the compartment comprising. The apparatus includes a door switch and a microprocessor for controlling an interior light source, an audible alarm, a visual alarm and the refrigeration system. The microprocessor includes manually adjustable timing algorithms for activating and deactivating these elements after a predetermined delay. User selectable switches for setting the desired functional operation of the apparatus and a manually depressible panic button are also provided. The panic button is located within the refrigerated compartment for manually activating and deactivating the interior light source, the audible alarm, the visual alarm and/or refrigeration system as well as resetting the timing algorithms.

27 Claims, 17 Drawing Sheets

DOOR MONITOR APPARATUS FOR INTERRUPTING AND RESTORING WALK-IN REFRIGERATION SYSTEM OPERATION AND ALARM MONITORING SYSTEM THEREFOR

CROSS-REFERENCE TO RELATED APPLICATIONS

This application claims the benefit of U.S. Provisional Application No. 60/189,319, filed Mar. 14, 2000.

COPYRIGHT NOTICE

A portion of the disclosure of this patent document contains material that is subject to copyright protection. The copyright owner has no objection to the facsimile reproduction by anyone of the patent disclosure, as it appears in the U.S. Patent and Trademark Office patent files or records, but otherwise reserves all copyright rights whatsoever.

FIELD OF THE INVENTION

The present invention relates to devices designed to provide for controlled environments wherein personnel would be required to have access to, and periodically be required to work in these controlled environments. Many types of environments which provide for control of parameters such as temperature, humidity and the like may be fitted with the invention, but the primary application for the device is in utilization with environments such as walk-in coolers and freezers.

Specifically, the present invention relates to a device which incorporates both a switch means such as a magnetic contact mounted on the compartment door and door frame to sense status of the door being opened or closed, and a manually operated push button switch located inside of the compartment with functional integration between the two switches as sensors for the operation of the invention. Opening or closing of the compartment door or activation of the push button will cause the device to perform its intended functions, which include interruption and restoration of normal operation of systems and components that are in place to provide creation of the desired environment such as a refrigeration system, control of interior lighting which is provided for illumination of the compartment when personnel are inside and control of an audible, visual and remote notification annunciation system to indicate conditions such as the door being left ajar or operational conditions where annunciation to the user of pending or other functions of the device is desired.

BACKGROUND OF THE INVENTION

Principles of operation of refrigeration systems for walk-in coolers and freezers and the physical designs of these compartments are fairly standardized and well documented. An inherent component of walk-in coolers and freezers is the door and the doorway which provides access to the interior of the compartment. Obviously, this door and doorway are utilized by personnel as a means of entering and exiting the compartment to perform various tasks such as retrieving or returning perishables, stocking, cleaning, doing inventory and the like. While necessary for utilization of the compartment, opening of the door can have detrimental effects on overall system tags performance and can also have impact on perishable items that are contained within the walk-in. Whenever the door is opened, cold inside air is exchanged with warmer outside air, resulting in a substantial expenditure of energy needed in attempting to maintain compartment temperature as the system will constantly be calling for refrigeration to compensate for the door opened condition. This is particularly the case when the door is to be opened for a prolonged period of time such as when a compartment is being stocked with product. The thermal exchange of air that takes place also causes air outside of the compartment to drop in temperature which can be undesirable as well. In severe cases when a door is left open for too long a period of time or if a door is accidentally left ajar, this can cause damage to or spoilage of the product that is contained in the compartment.

Another matter of concern with walk-in coolers and freezers is exposure of personnel to the environment created by the operating refrigeration system. Attempting to perform any of the aforementioned operational or maintenance tasks with the refrigeration system running exposes personnel to abnormally cold temperatures, particularly in walk-in freezers. This condition becomes more dramatic when personnel have work to do inside of a compartment for a prolonged period of time and have elected to work with the door closed so as to minimize thermal exchange. In these instances, temperatures can become extremely uncomfortable and even life threatening.

Another component that is integral to virtually all walk-in coolers and freezers is illumination means for the interior of the compartment. These illumination means are typically controlled by a light switch adjacent to the door of the compartment. Operation of the light switch is personnel dependent with the result being that lights are often left on unnecessarily when the door is closed. While this does not adversely affect performance of the compartment or compromise product integrity, it nevertheless causes an unnecessary waste of energy and thus increases operating expenses.

There are numerous devices and techniques known in the field which, independently or in combination, attempt to address these situations. For example, regarding refrigeration functions, there are various timing devices, both mechanical and electronic, which can be used to disable operation of the fans and solenoid valve so as to temporarily interrupt operation of the refrigeration system. These devices are typically manually activated and will interrupt operation for a selected period of time after which the refrigeration system will automatically restart. While these devices are effective for their intended purpose they are limited in that they only respond to their internal timing mechanisms and have no connection with functional operation of the box such as whether the door is opened or closed. They will only turn refrigeration back on when they have "timed out", even if the task for which they have been activated has been completed and ideally, the refrigeration system should have restarted.

Another approach often used is to mount a switch on the door frame which deactivates the fans and solenoid valve when the door is opened and reactivates them when the door is closed. However, this method has a number of disadvantages. Firstly, turning components on and off every time the door is opened or closed can cause excessive wear to the solenoid valve, the fans and the compressor. This is particularly true of food service facilities, where doors can be opened and closed frequently, especially at busy times of the day when personnel are entering and exiting the compartment to retrieve and return perishable items. Secondly, this approach does not provide a means for working inside of the compartment with the refrigeration off when the door is closed. Thirdly, this approach can result in catastrophic product loss if a door is left even slightly ajar as the refrigeration system in this scenario would not turn back on. All of these represent significant shortcomings to utilizing this method.

There are also manually operated techniques that are utilized such as switches that will allow personnel to shut off the fans and solenoid valve so as to temporarily de-activate the refrigeration system when so desired. However, these methods rely on human responses for proper operation and thus suffer from the same flaws as those that are apparent with light switches. If personnel fail to re-activate the refrigeration system the results can be disastrous with substantial loss of perishable items.

Regarding audible, visual and remote notification capable annunciation systems there are well known approaches and techniques which exist in the prior art that sense the status of the door and provide a door ajar alarm if the door is opened for too long. Some of these devices even incorporate a timed relay function to provide some interruption and restoration capability of the operation of the refrigeration system in response to the door being opened or closed. However, because of the limited capabilities of devices which are only a door ajar alarm or even in devices which offer some interruption and restoration capabilities, the annunciation system functions only as a door ajar alarm and it is not designed or intended to annunciate any other pending functions of the device. Also, none of these devices offers a means for activation other than sensing the status of the door, so functionality is limited. Additionally, none of the aforementioned devices provides automatic control of interior illumination means.

It is, therefore, desirable to create an apparatus that provides a method and a means for addressing these shortcomings by firstly, combining refrigeration system interruption and restoration functions, control of illumination means functions, and audible, visual and remote notification functions into an appropriately configured and functionally integrated device, and secondly, providing a dual input sensor means that both senses the status of the door and also provides manual user activation capability with functional integration of operation between these two sensors as a means for accessing device functions.

OBJECTS AND SUMMARY OF THE INVENTION

Accordingly, it is an object of the present invention to provide a means for interruption and restoration of operation of a refrigeration or environmental system.

It is another object of this invention to provide a means for integrating status of the compartment door being opened or closed with interruption and restoration of operation of the refrigeration system.

It is another object of this invention to provide a means for manually interrupting operation of a refrigeration system.

It is another object of this invention to provide a two input sensing means in the form of a switch such as a magnetic contact to monitor the status of the door and a switch such as a push button mounted inside of the compartment to provide manual activation with functional integration between the two switches as a means for interruption and restoration of operation of a refrigeration or environmental system.

It is another object of this invention to provide a user adjustable means for delaying interruption of operation of a refrigeration system for a selected period of time relative to when the compartment door is first opened.

It is another object of this invention to provide a means for control of illumination means for the interior of a refrigerated or environmental room.

It is another object of this invention to provide a means for integrating status of the compartment door being opened or closed with control of illumination means for the interior of a refrigerated or environmental room.

It is another object of this invention to provide a means for manual activation of illumination means for the interior of a refrigerated or environmental room.

It is another object of this invention to provide a two input sensing means in the form of a switch such as a magnetic contact to monitor the status of the door and a switch such as a push button mounted inside of the compartment for manual activation with functional integration between the two switches as a means for control of illumination means for the interior of a refrigerated or environmental room.

It is another object of this invention to provide a means for annunciating a door ajar alarm condition or other function of the device.

It is another object of this invention to provide an audible and a visual alarm as well as an alarm relay for remote notification purposes as a means for annunciating either a door ajar alarm condition or other function of the device.

It is another object of this invention to provide a user adjustable means for delaying activation of the audible alarm for a selected period of time relative to when the door is first opened.

It is another object of this invention to provide a means for automatically restoring operation of a refrigeration system in a door ajar alarm condition.

It is another object of this invention to provide a means for sequentially integrating audible door ajar alarm annunciation with automatic restoration of operation of a refrigeration system.

All of the above objectives are incorporated into the invention and will function in a manner as determined by the software and/or circuit design and in accordance with settings of user adjusted parameters as described in the detailed description of the preferred embodiments.

The present invention is an apparatus for monitoring, indicating and controlling conditions of a refrigeration system having a refrigerated compartment, a door for accessing the refrigerated compartment, an interior light source for illuminating the interior of the compartment and a fan and coolant valve arrangement for refrigerating the compartment comprising. The apparatus generally includes a door switch for detecting an open or closed condition of the door to the refrigerated compartment, a light relay for providing power to the interior light source of the compartment in an activated state and for terminating power to the light source in a deactivated state and a microprocessor electrically connected with the door switch and the light relay for activating the light relay when the door switch detects a door open condition. The microprocessor further includes an interior light timing algorithm for deactivating the light relay after a predetermined delay when the door switch detects a door closed condition.

Preferably, the apparatus further includes an audible alarm electrically connected to the microprocessor and the microprocessor further includes a manually adjustable alarm timing algorithm for activating the audible alarm after a predetermined delay when the door switch detects a door open position.

Preferably, the apparatus further includes a visual alarm electrically connected to the microprocessor that is activated by the microprocessor when the door switch detects a door open position.

In alternate embodiments of the present invention, the apparatus further includes a fan relay electrically connected to the microprocessor for providing power to the fan of the refrigeration system in a deactivated state and for terminating power to the fan in an activated state and a valve relay electrically connected to the microprocessor for providing power to the coolant valve of the refrigeration system in a deactivated state and for terminating power to the coolant valve in an activated state. Activation of the fan relay and the valve relay can be controlled by a user selectable switch. When the switch is in a first position, the microprocessor activates the fan relay and the valve relay when the door switch detects a door open position. When the switch is in a second position, the microprocessor activates only the fan relay when the door switch detects a door open position. In this embodiment, the microprocessor may include a manually adjustable refrigeration timing algorithm for activating the fan relay and the valve relay after a predetermined delay when the door switch detects a door open position and for deactivating the fan relay and the valve relay after a predetermined delay. The refrigeration timing algorithm can also be programmed to deactivate the fan relay and the valve relay after a predetermined delay after the audible alarm is activated.

In another embodiment, the apparatus includes a manually depressible push button electrically connected to the microprocessor. The push button is located within the refrigerated compartment for manually activating various device functions. If the audible alarm has been activated due to a door open condition, the push button can be made to deactivate the audible alarm and reset the alarm timing algorithm when depressed. If refrigeration operation has been restored as a result of a door ajar alarm occurring, the push button may further perform the function of activating the fan relay and the valve relay to terminate refrigeration operation when depressed. If the door is closed, the push button, when momentarily pressed, will cause the light relay to activate or remain activated so that the interior of the refrigerated compartment will remain illuminated, and will also perform the function of activating the fan relay and the valve relay to terminate refrigeration operation. Additionally, the push button, when momentarily pressed, will reset certain alarm algorithms which may occur when the door is closed. If depressed for a predetermined period of time when the door is closed, the push button provides immediate activation of certain alarm algorithms contained within the microprocessor. These include activation of all alarm annunciators, activation of the light relay so that the interior of the compartment will remain illuminated, and activation of the fan relay and the valve relay to terminate refrigeration operation.

Preferably, the push button is accompanied by a secondary audible annunciator such as a piezo type horn that is connected to and is activated by the microprocessor. The purpose of this horn is to provide audible notification inside of the compartment of pending functions of the device that require a response to personnel who may be contained therein.

Thus, the present invention provides a self-contained and functionally integrated apparatus which provides interruption and restoration capabilities of operation of a refrigeration or environmental system, control of interior illumination means, an audible and visual annunciation system to annunciate a door ajar condition or a pending or other function of the device and a dual input sensing means consisting of magnetic contacts to monitor the door status and a push button switch to be mounted inside of the compartment with operational integration between the two input switches so that all possible modalities of operation for the compartment are addressed as a means for operating and controlling the apparatus.

For a better understanding of the present invention, reference is made to the following detailed description to be taken in conjunction with the accompanying drawings and its scope will be defined in the appended claims.

DETAILED DESCRIPTION OF THE PREFERRED EMBODIMENTS

FIGS. 1 through 4 will be utilized to describe the invention in the preferred embodiment. While the invention will be described in connection with the preferred embodiment, it will be understood that it is not intended to limit the invention to this embodiment. On the contrary, it is intended to cover all alternatives, modifications and equivalents as may be included within the scope and spirit of the invention as defined by the claims.

Figure 1:
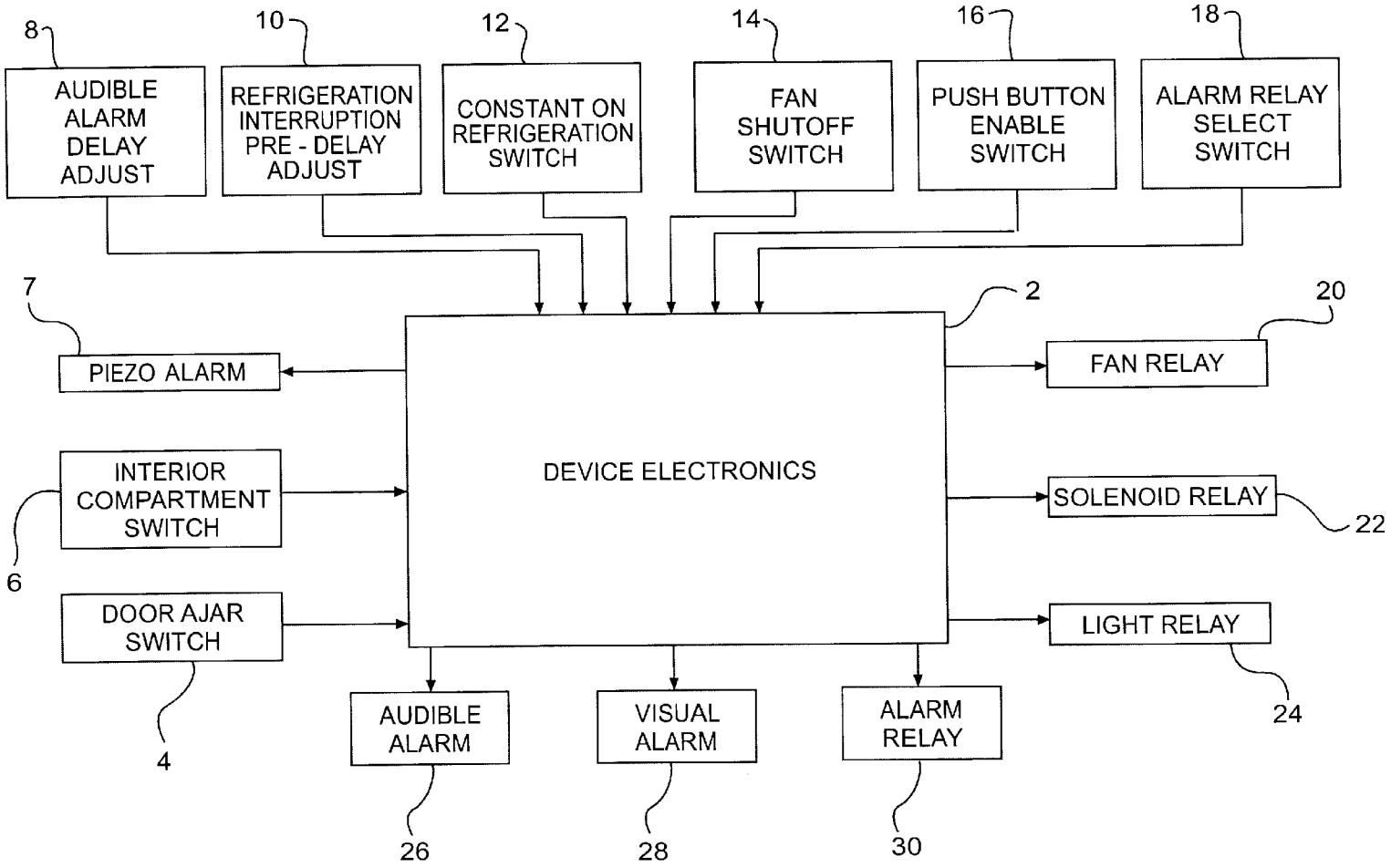
FIG. 1 is a block diagram of the components and functional configuration of the apparatus formed in accordance with the present invention.

Referring to FIG. 1, central to the operation of the invention is the device electronics (2), which contains the circuitry and power supply necessary for the apparatus to perform its intended functionality. The device electronics can be based on a purely hardware design using discrete components such as logic gates, timers and other electronic components configured into a circuit which will perform this functionality, or it can be based on a microprocessor or micro controller design whereby, in addition to circuit configuration, the functionality is defined by a software program. In either approach the resultant performance of the preferred embodiment will be the same.

The door ajar switch (4) is utilized to sense the status of the door being opened or closed. In the preferred embodiment, the operation of this switch is to make contact when the door is closed and to break contact when the door is opened. Any type of electromechanical switch which operates in this manner may be employed, but the preferred type is a magnetic contact as these are low in cost, easy to install and highly reliable. With a magnetic contact, door status is easily sensed and monitored by mounting the magnetic contact on the door frame and the magnet on the door itself.

The interior compartment switch (6) is utilized to provide access to device functions which are manually activated. In the preferred embodiment, the interior compartment switch (6) is a momentary, normally open, push button switch which makes contact when pressed. Due to certain functions of the interior compartment switch, (6) it is essential for proper operation that the interior compartment switch (6) is mounted inside of the compartment, preferably adjacent to the door. The reasons for this will become apparent upon further disclosure of the operation of the device in the preferred embodiment. Additionally, in the preferred embodiment, this switch is illuminated so that it may be easily located inside of the compartment.

The piezo alarm (7) is utilized to provide audible annunciation of pending device functions to personnel who may be inside of the monitored compartment when such annunciation occurs. As with the interior compartment switch, (6) the piezo alarm (7) must be mounted inside of the compartment in order to provide its intended functions. In the preferred embodiment, the piezo alarm (7) is to be mounted immediately adjacent to the interior compartment switch itself (6).

The audible alarm delay adjustment (8) and the refrigeration interruption pre-delay adjustment (10) are itemized on the block diagram in order to explain the functionality of these adjustments. However, in the preferred embodiment, these adjustments, as well as the timing functions that they affect, are integrated into and are part of the device electronics. The constant on refrigeration switch (12), the fan shutoff switch (14), the push button enable switch (16), and the alarm relay select switch (18) are also itemized on the block diagram in order to explain the functionality of these switches. However, in the preferred embodiment, these switches are integrated into and are part of the device electronics. The fan relay (20), the solenoid relay (22), the light relay (24) and the alarm relay (30) are also itemized on the block diagram for the purpose of explaining the operation of the invention. While these devices may be mounted remotely if so desired, they are also integrated into and are part of the device electronics in the preferred embodiment. The audible alarm (26) and visual alarm (28) as with the other aforementioned components, are itemized for the purpose of explaining the operation of the invention.

Figure 2:
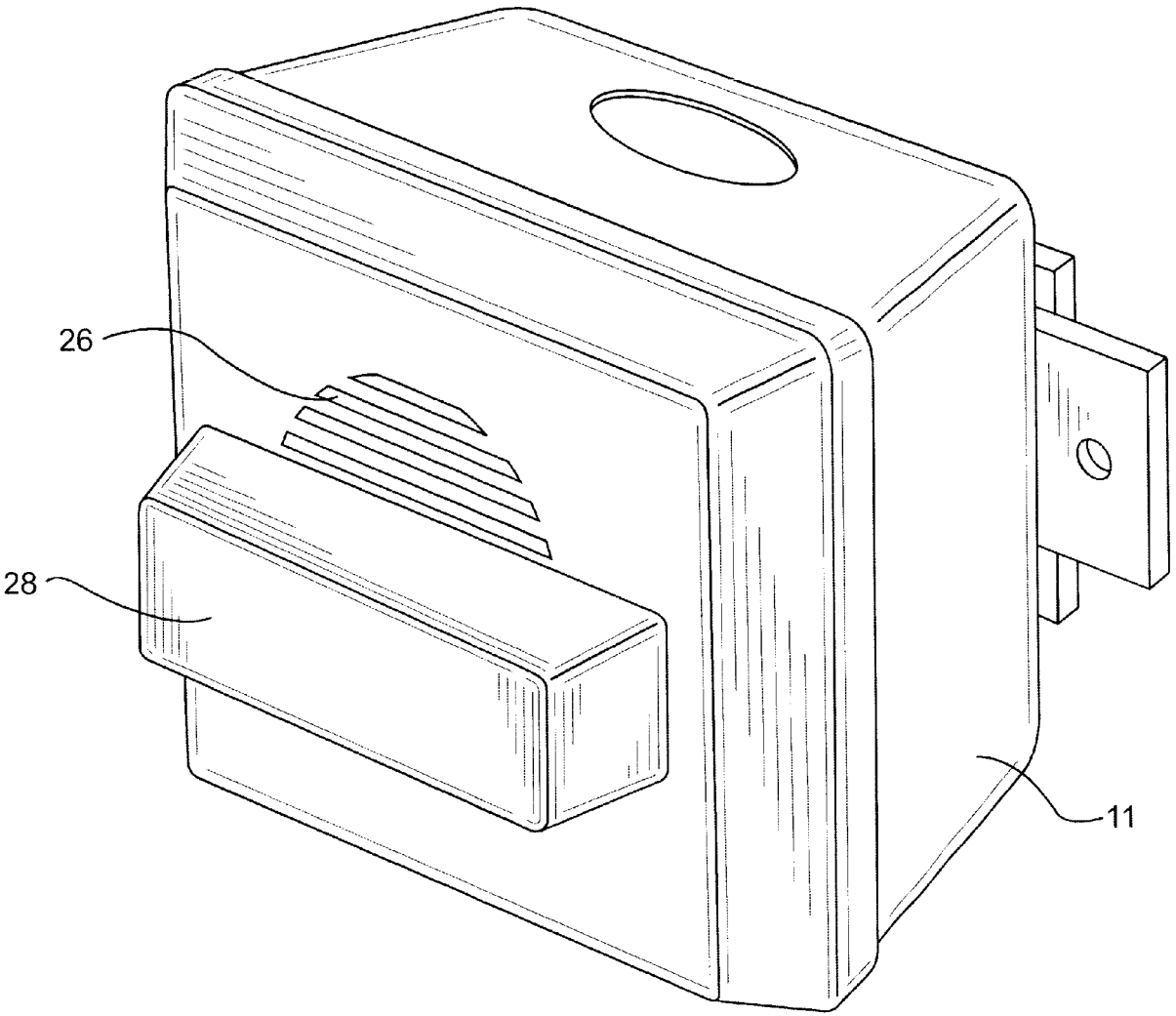
FIG. 2 is a top perspective view of the housing of the apparatus formed in accordance with the present invention.
Figure 3A:
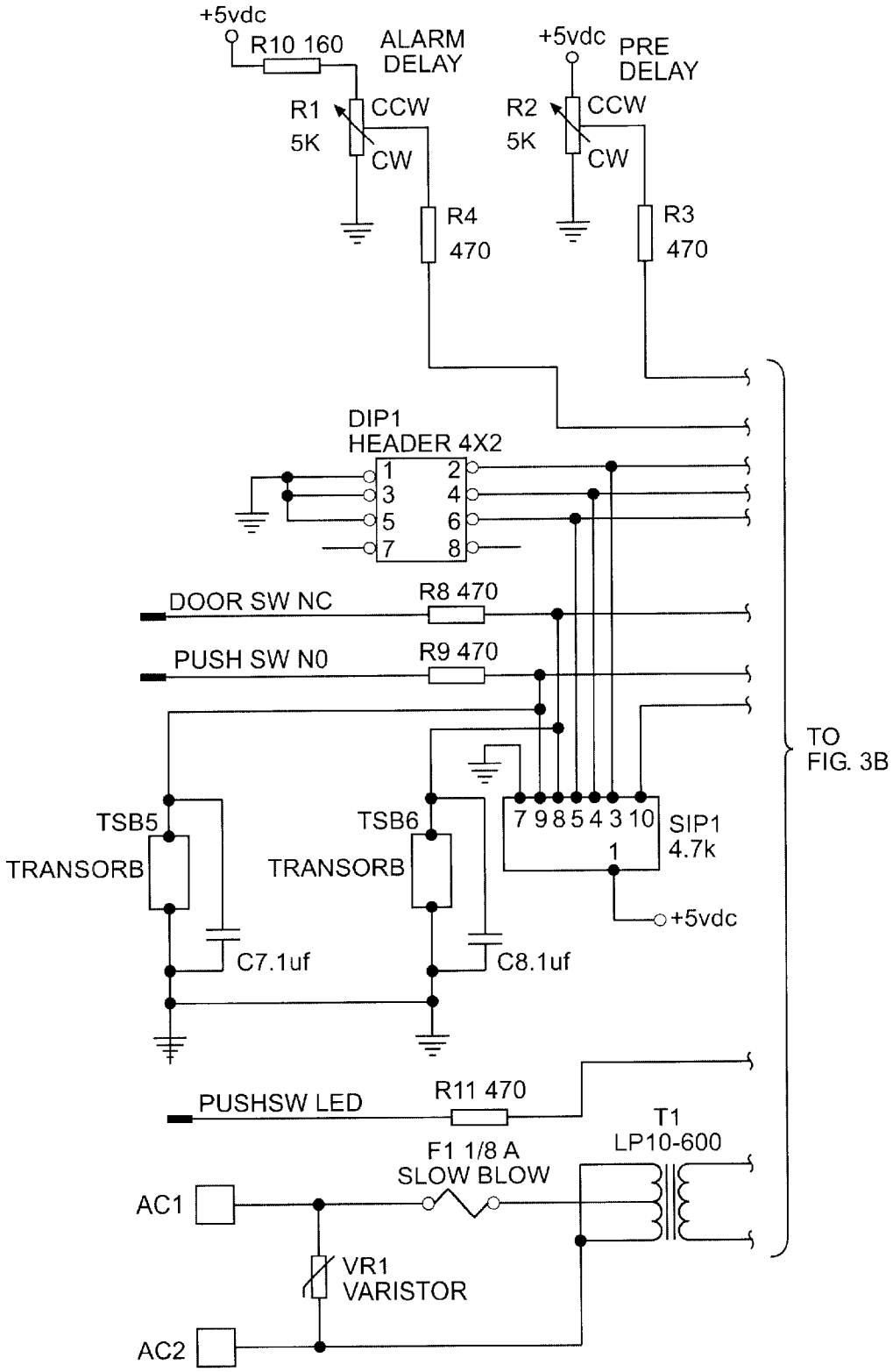
FIGS. 3A–3D is a detailed schematic drawing illustrating the circuitry of the present invention.
Figure 3B:
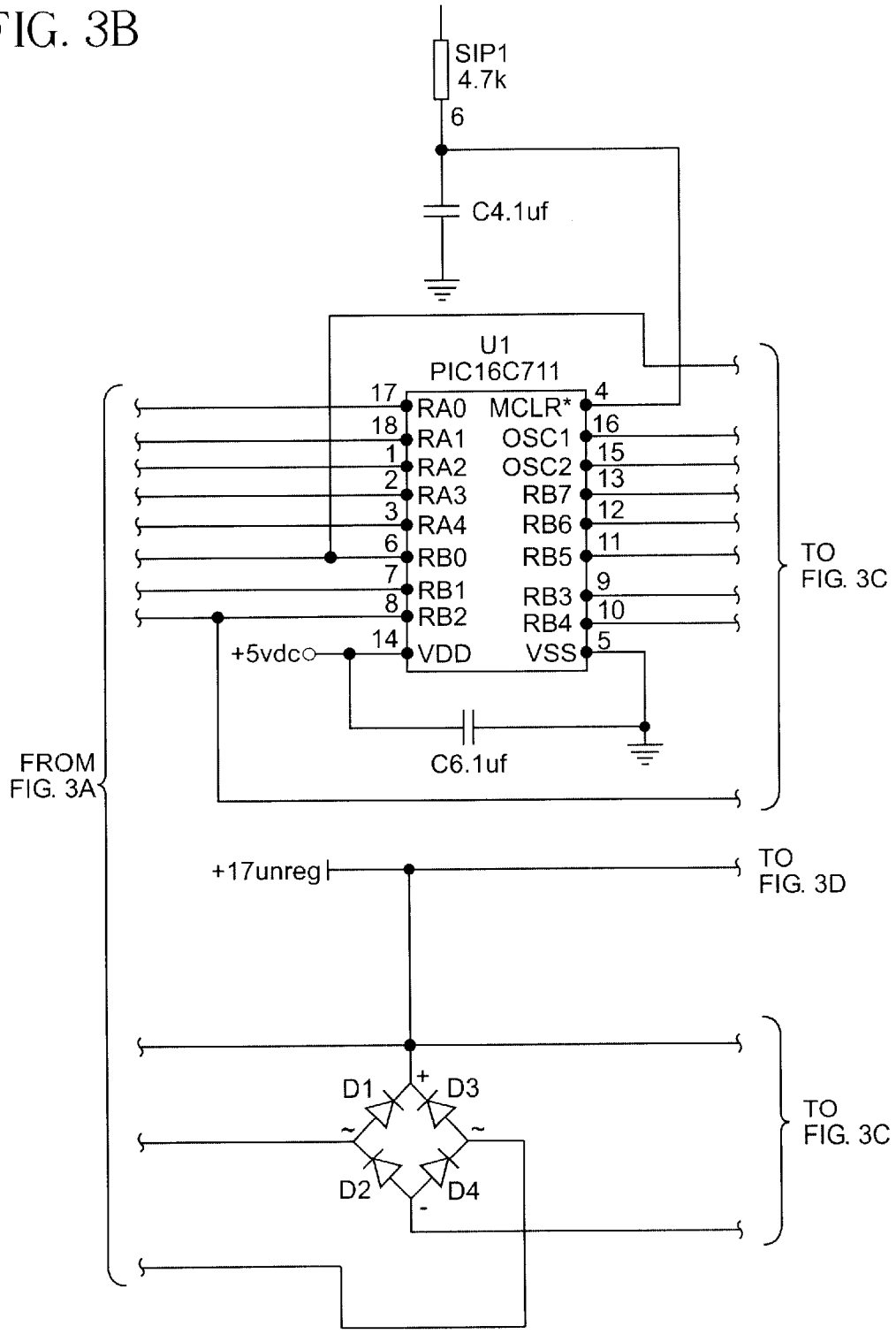
Figure 3C:
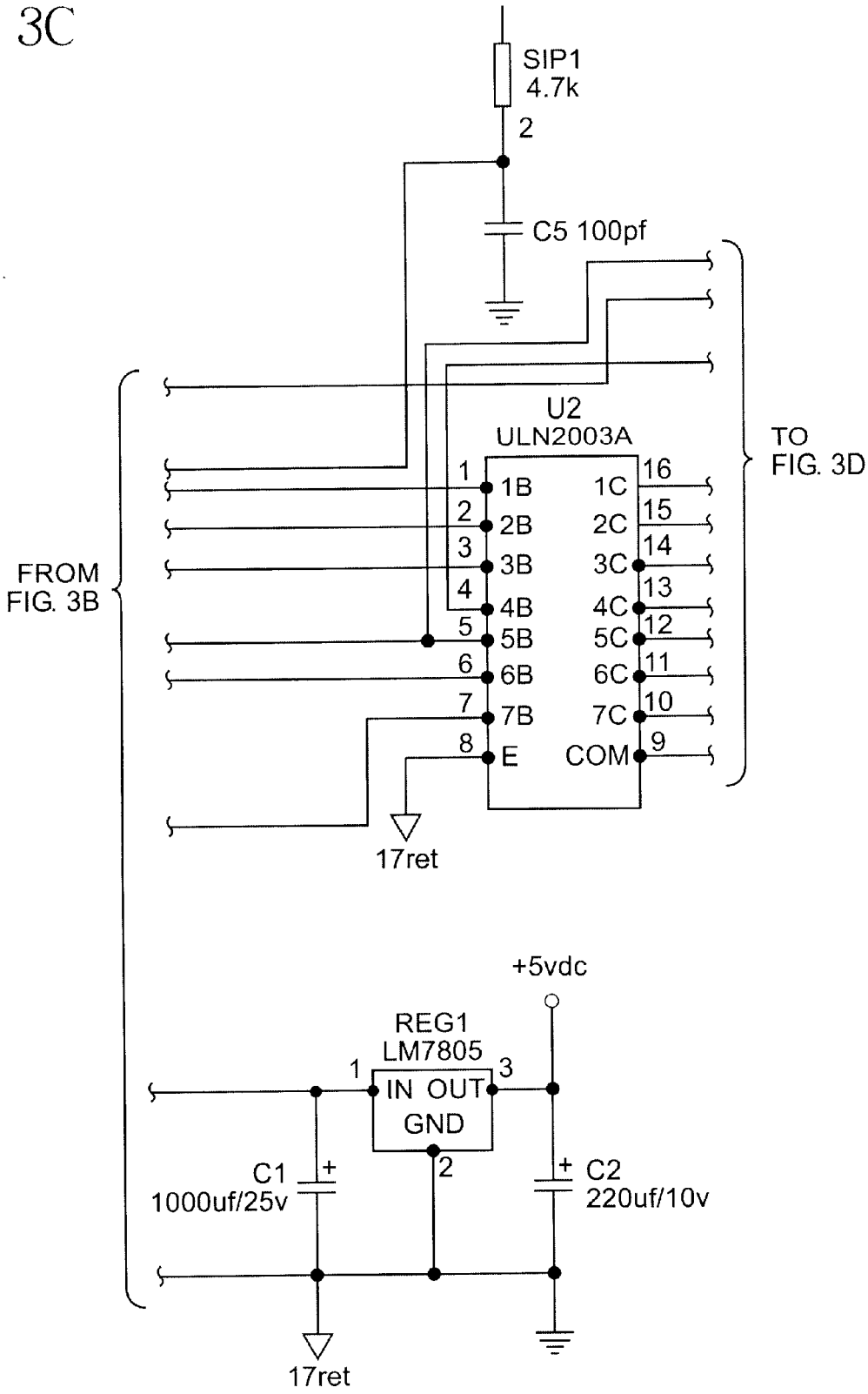
Figure 3D:
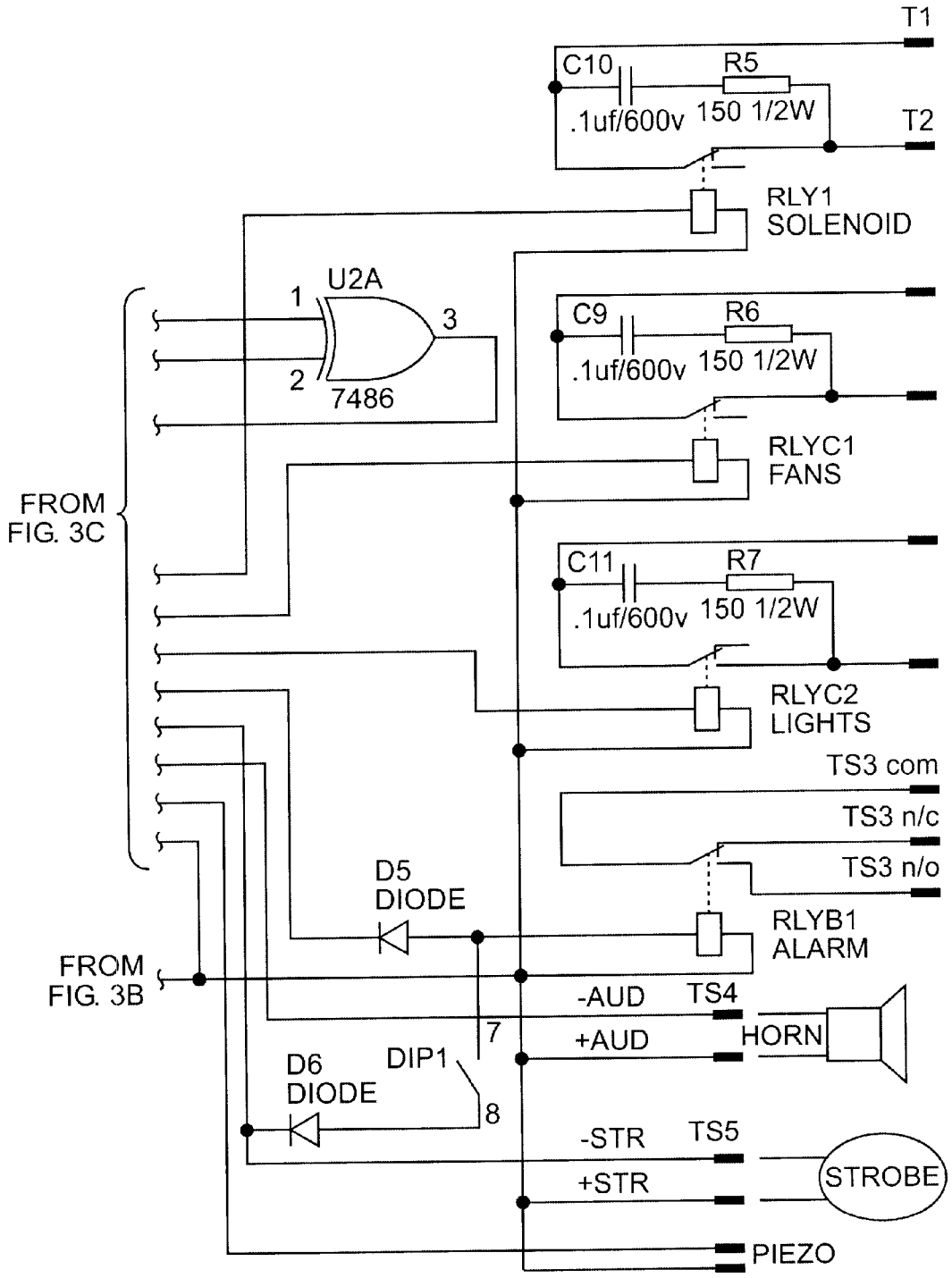
Figure 4A:
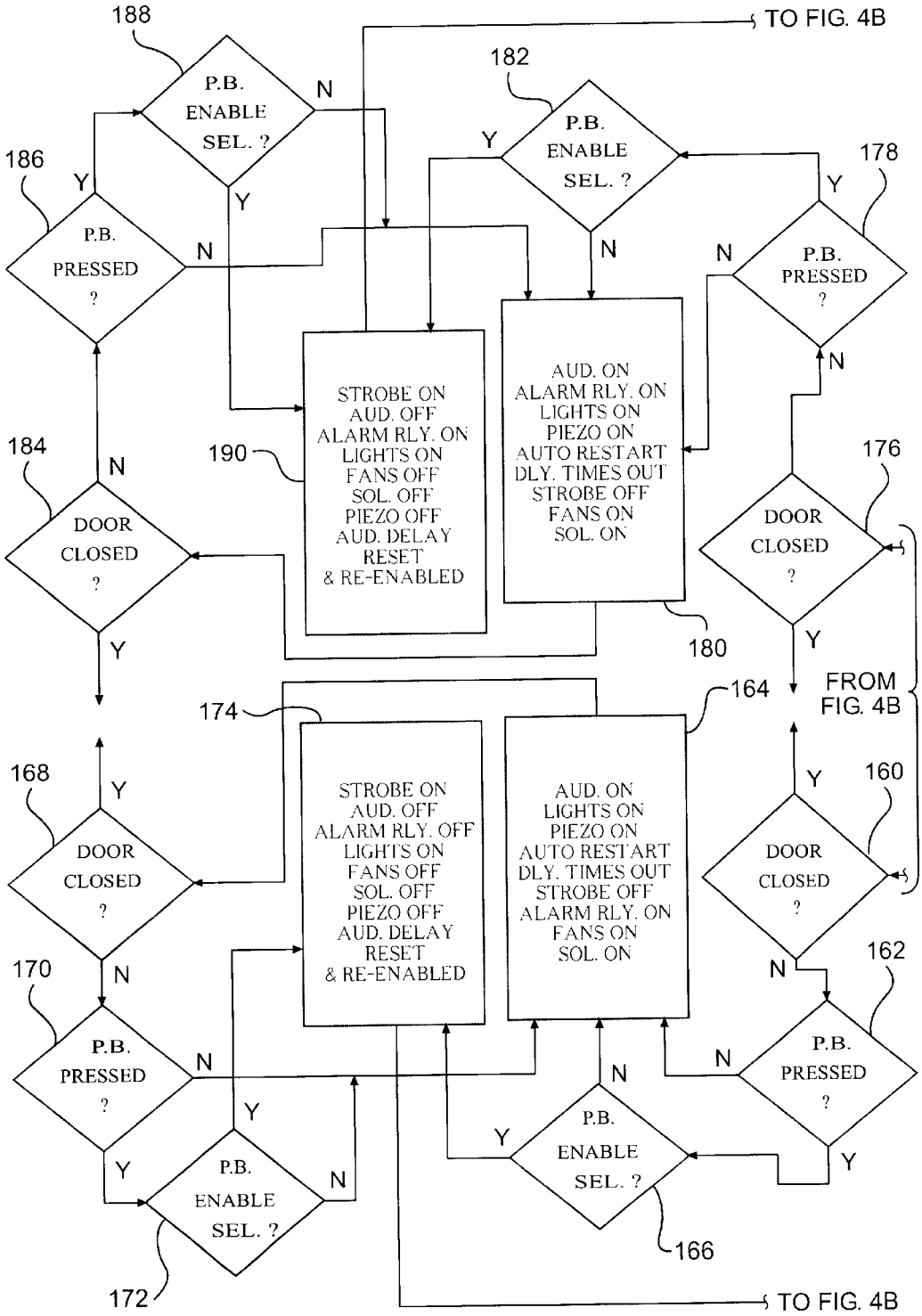
FIGS. 4A–4K is a flow chart showing the functional operations of the apparatus of the present invention.
Figure 4B:
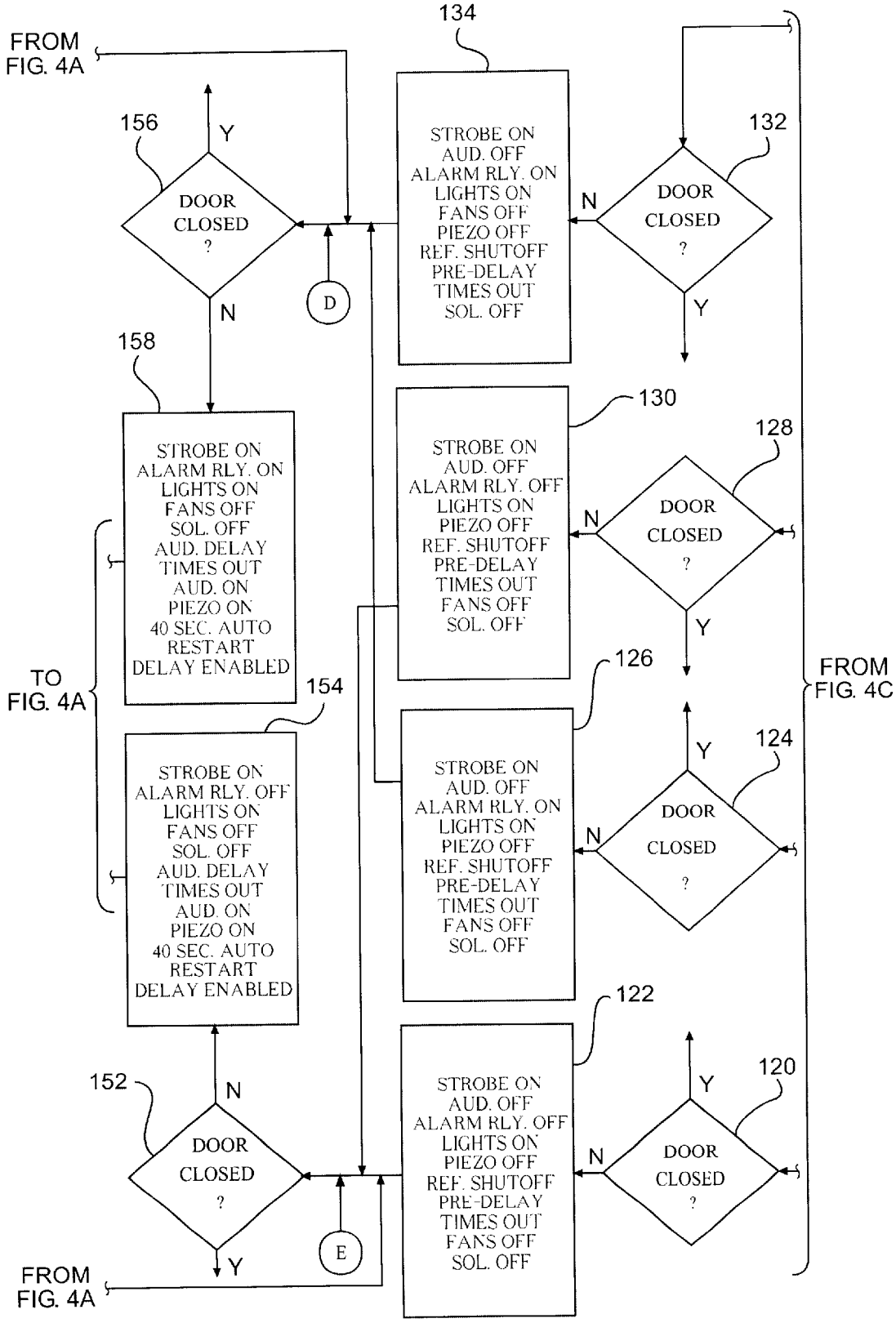
Figure 4C:
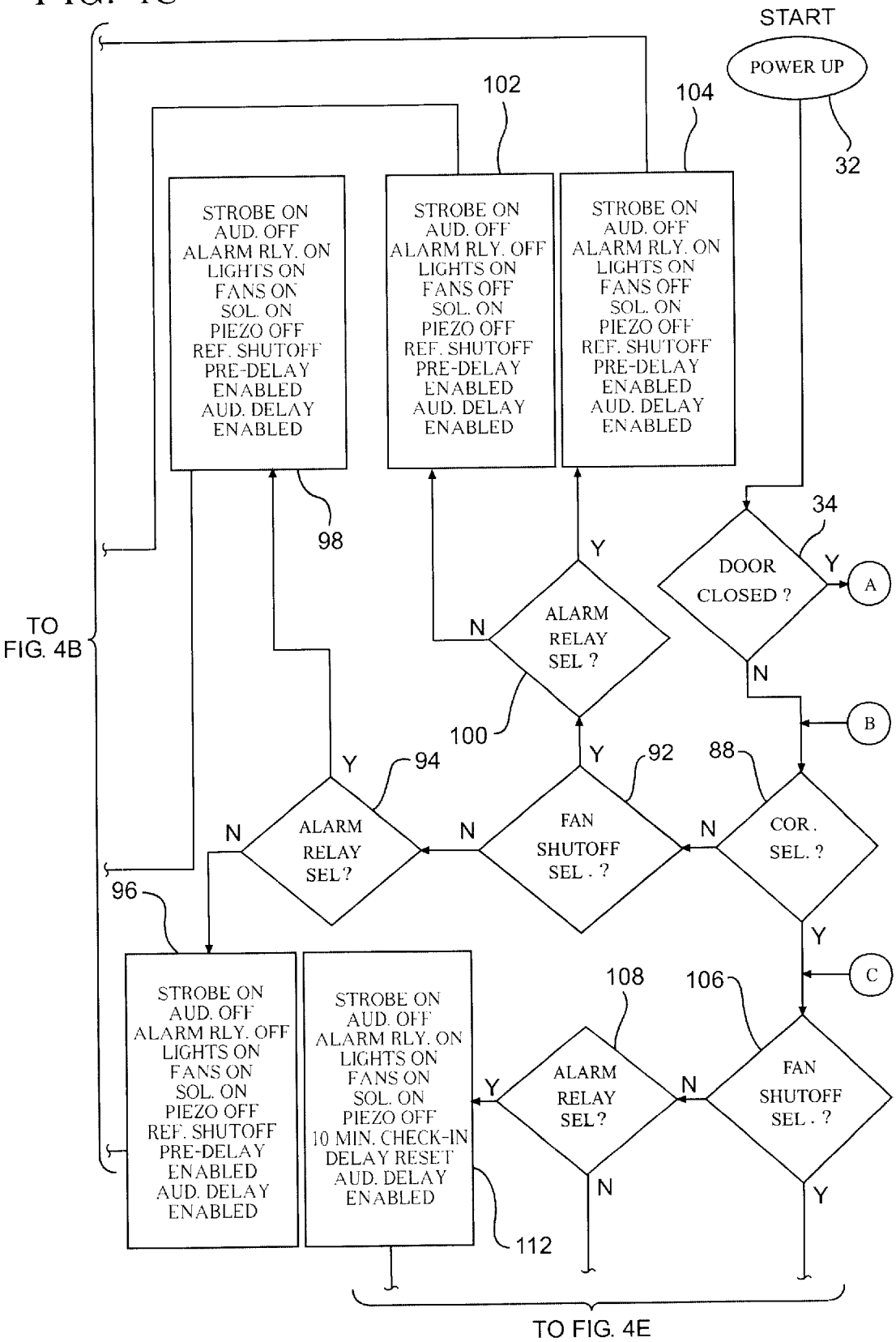
Figure 4D:
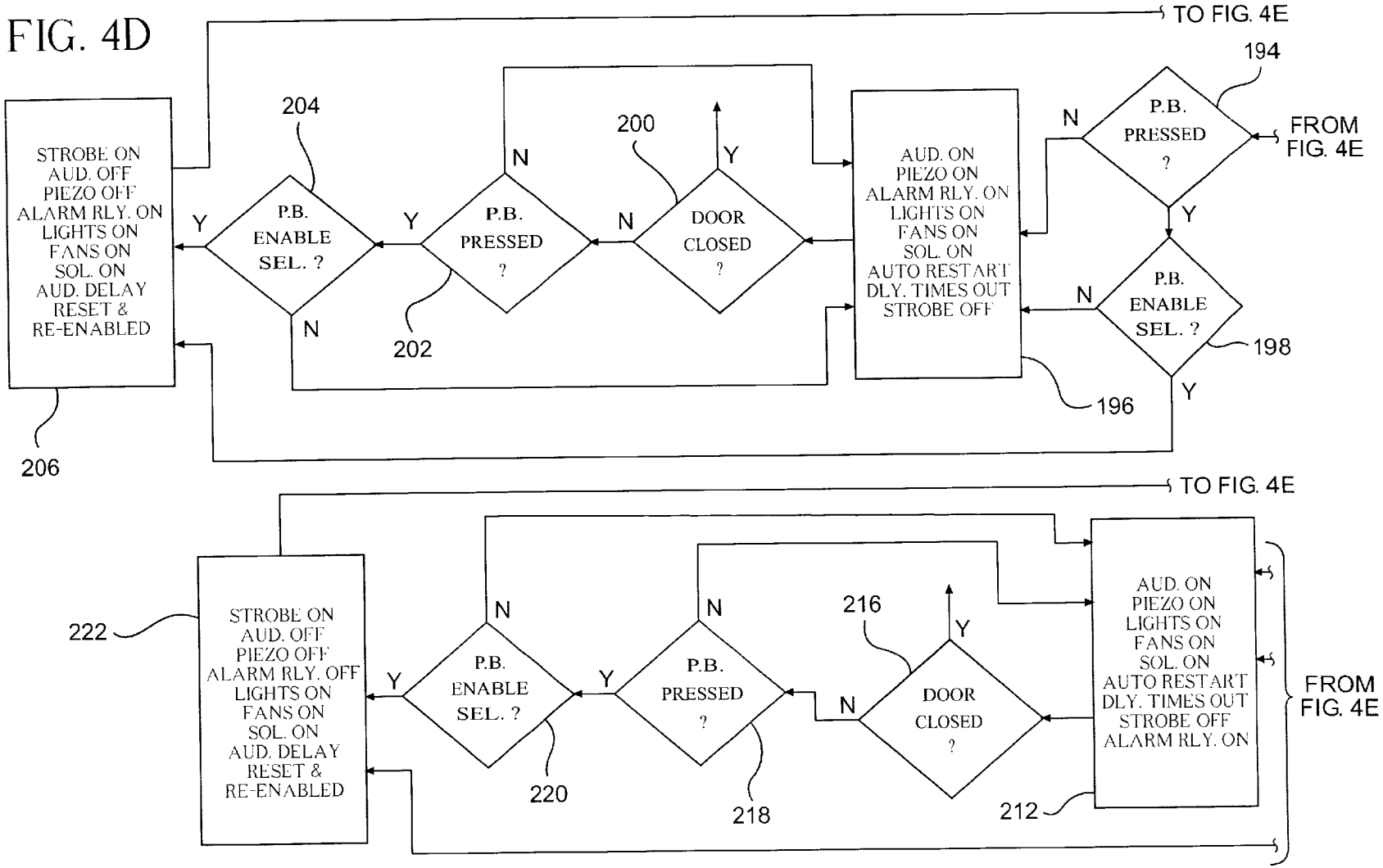
Figure 4E:
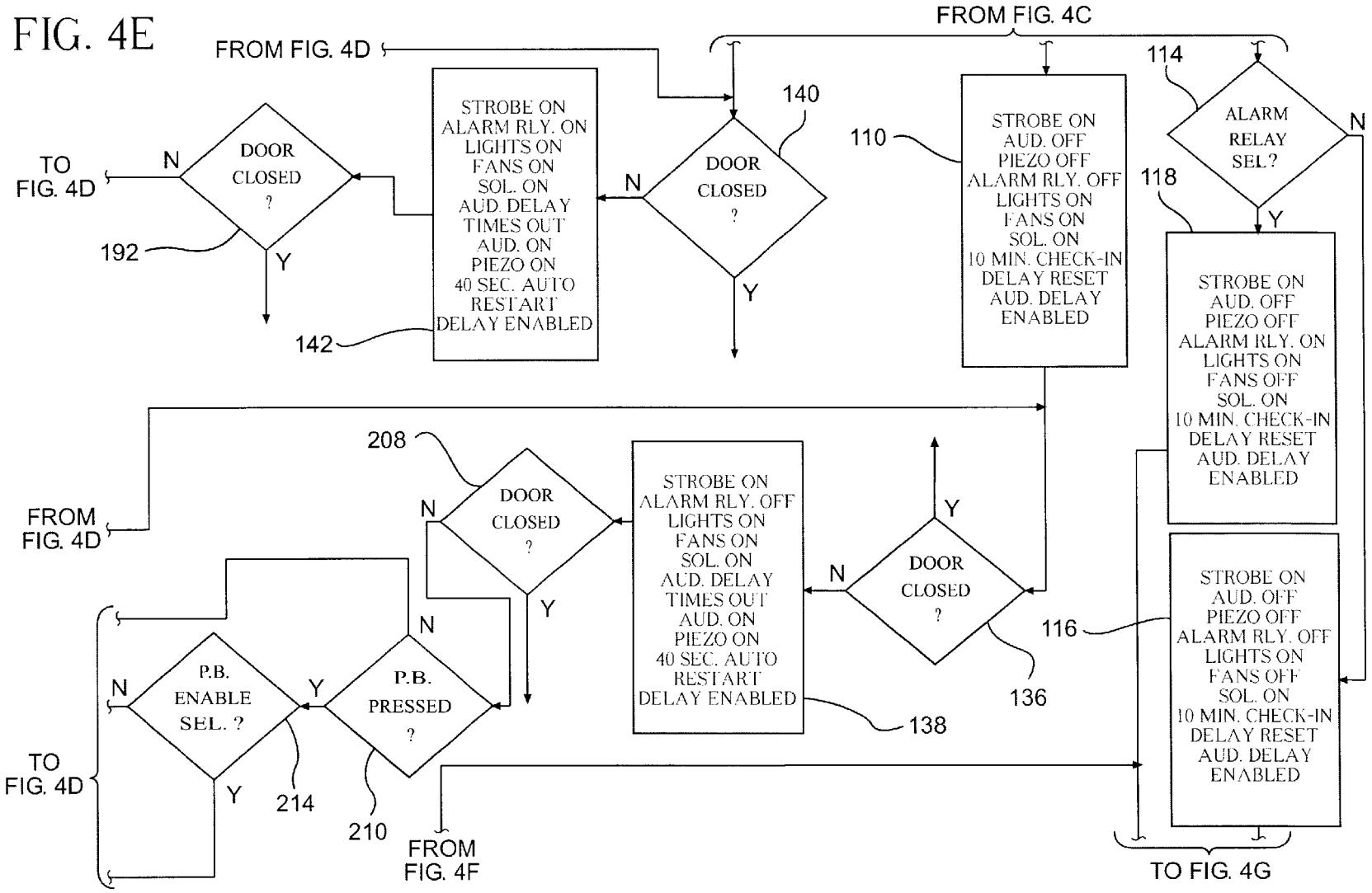
Figure 4F:
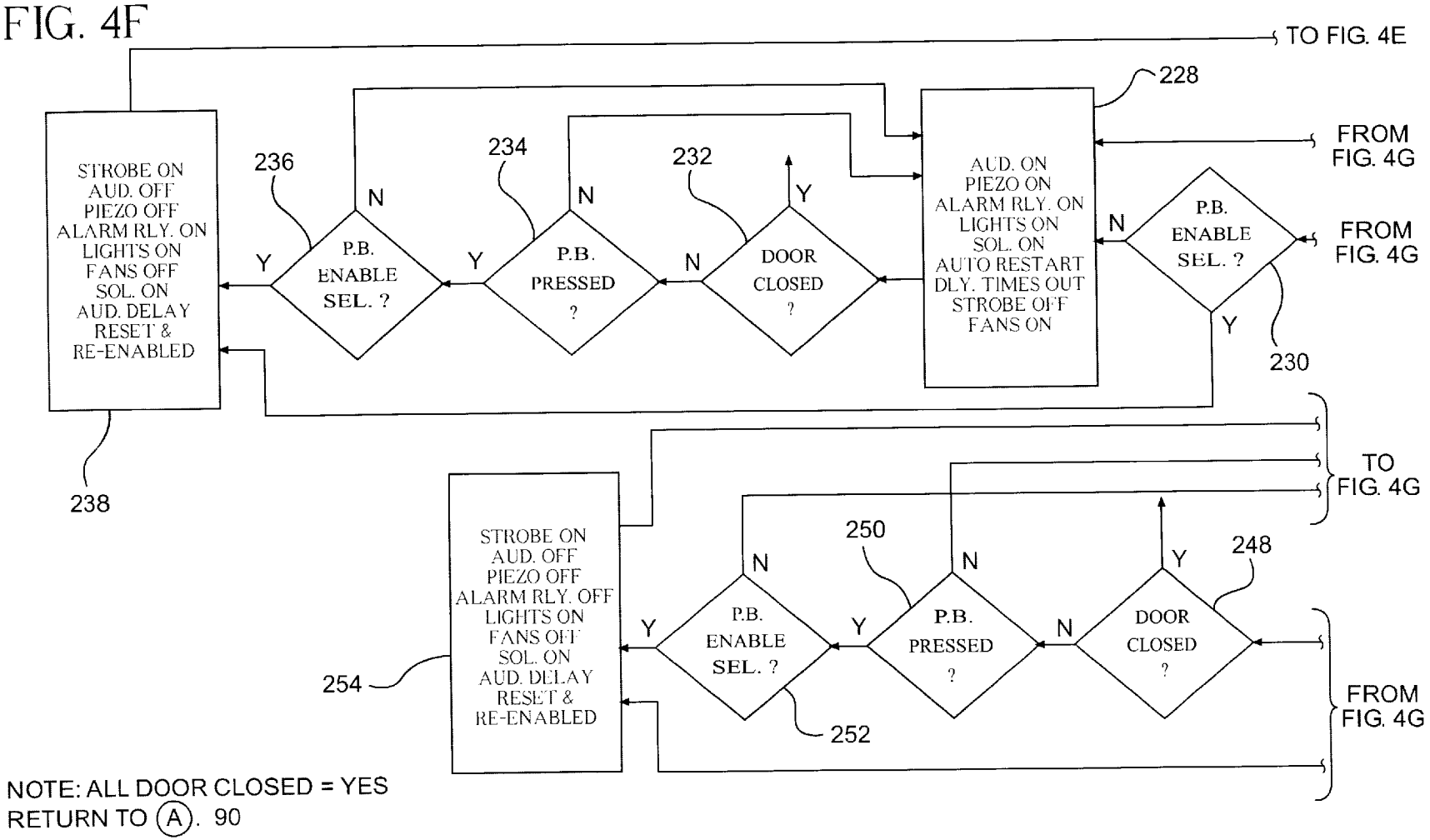
Figure 4G:
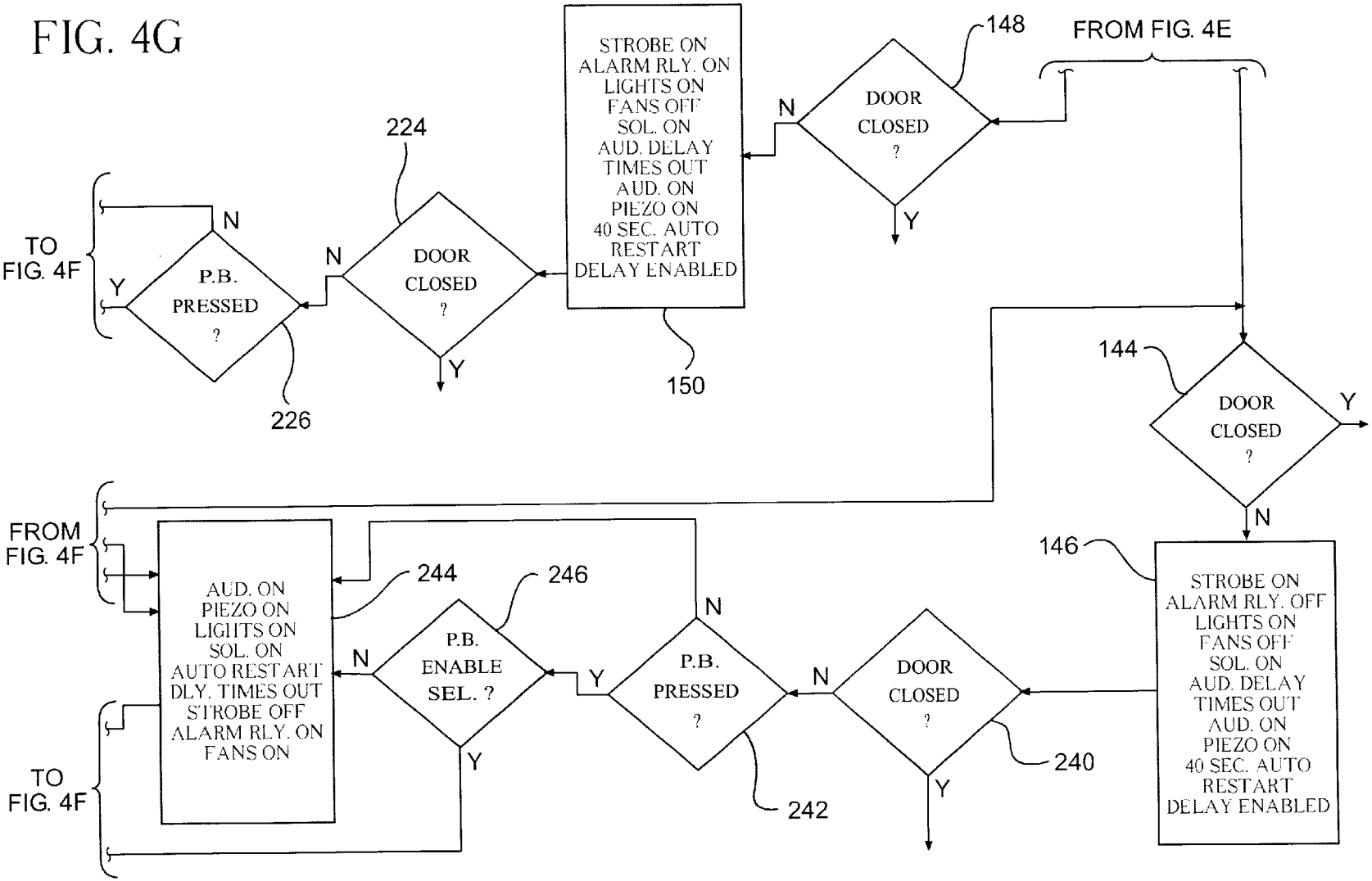
Figure 4H:
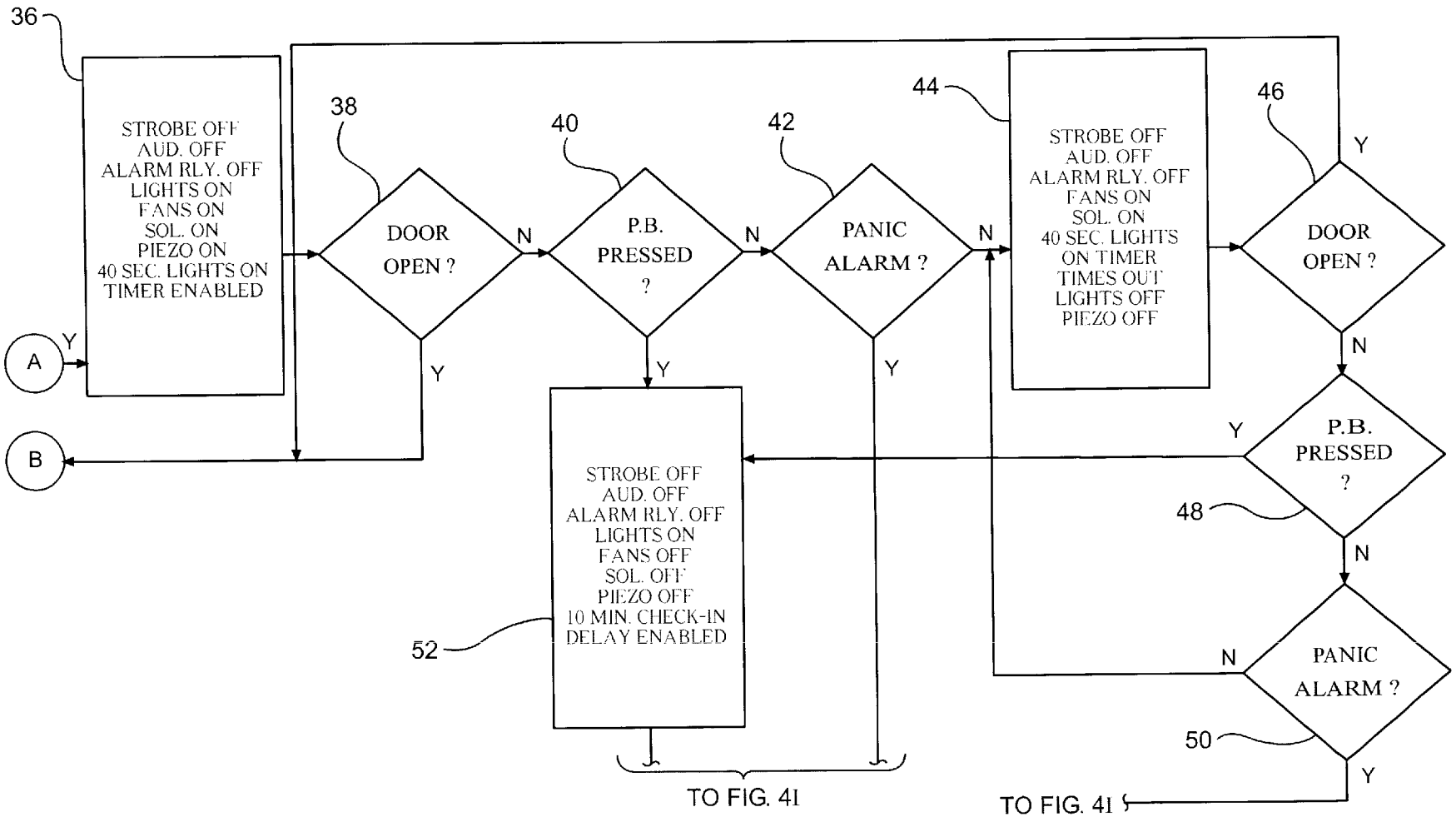
Figure 4I:
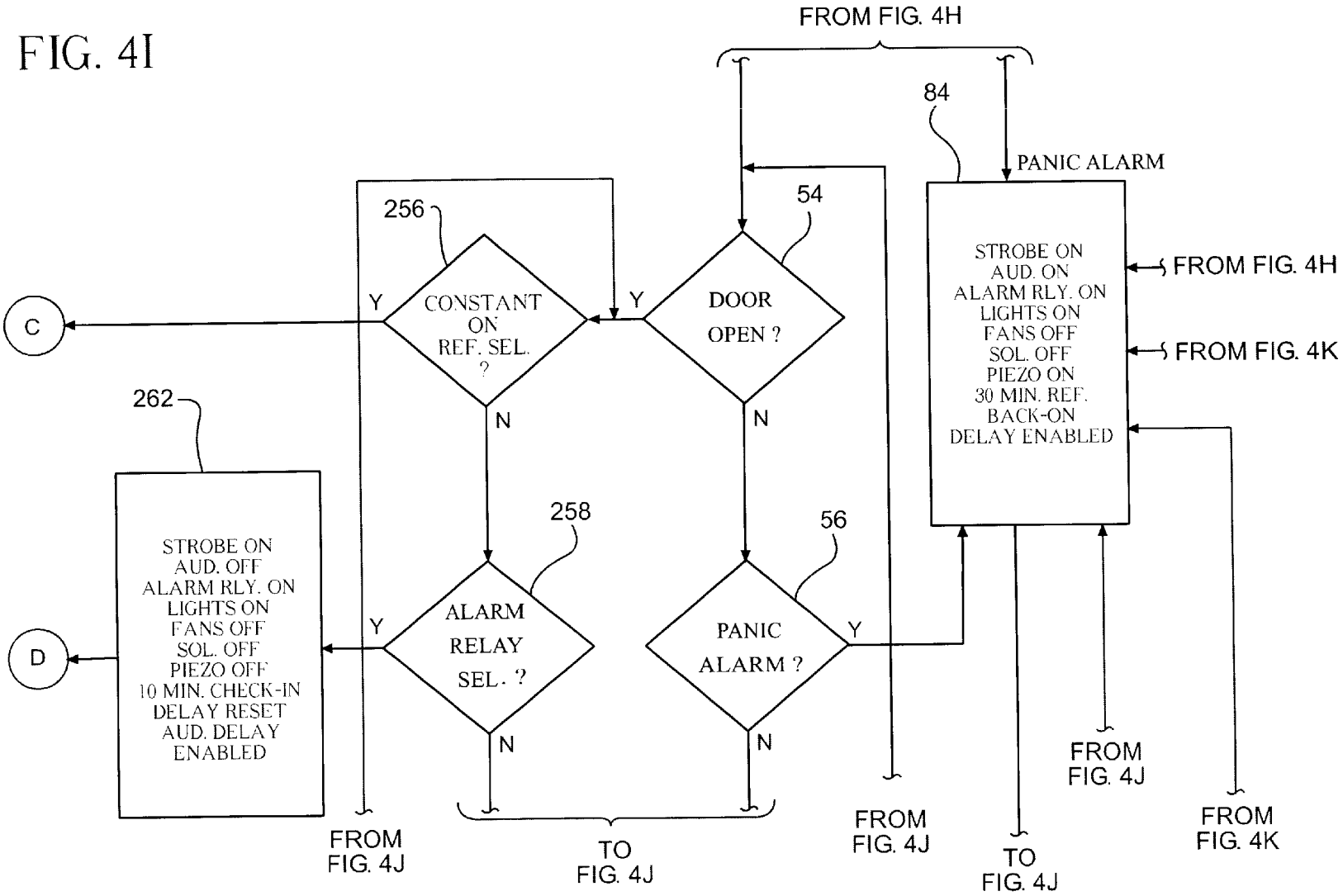
Figure 4J:
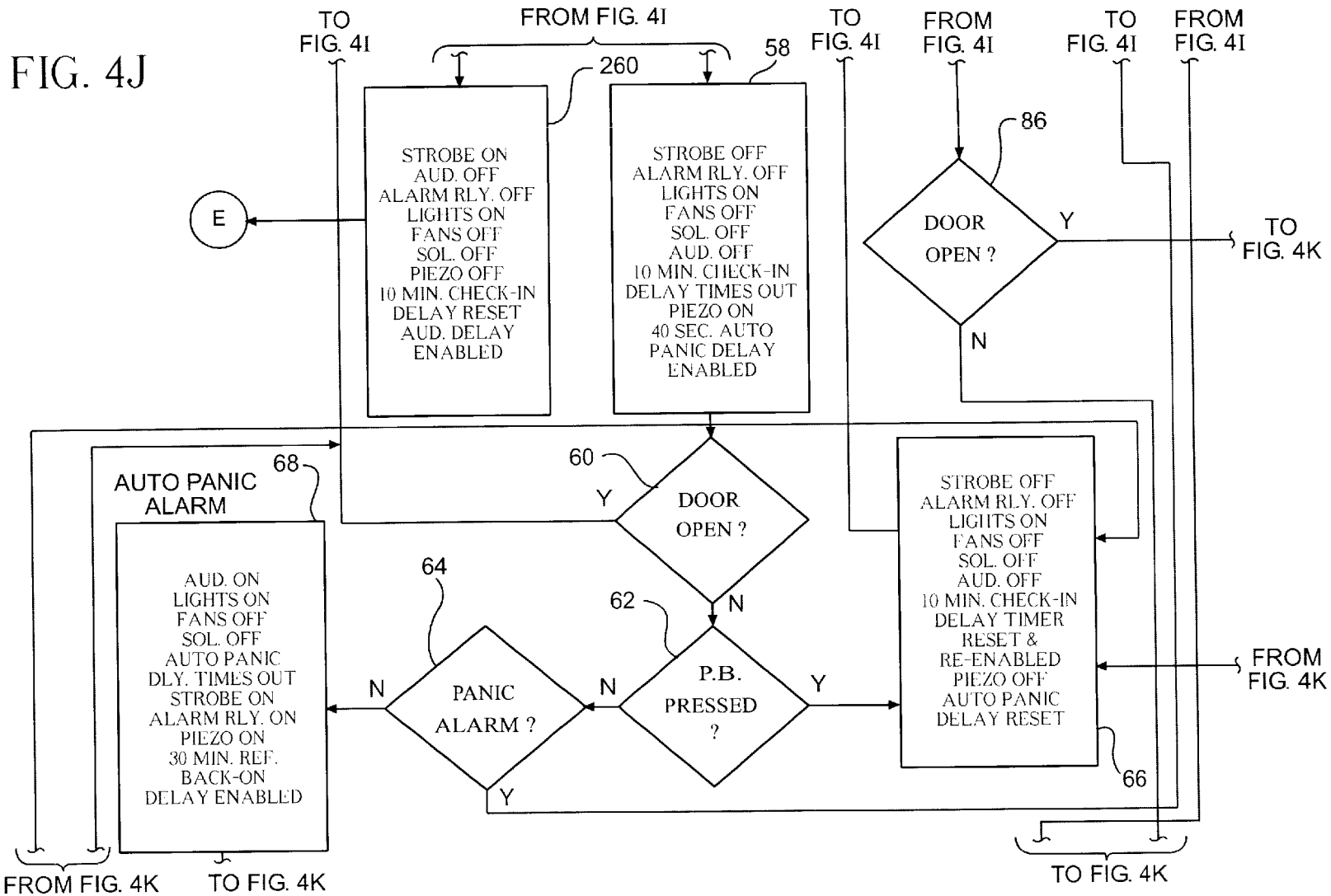
Figure 4K:
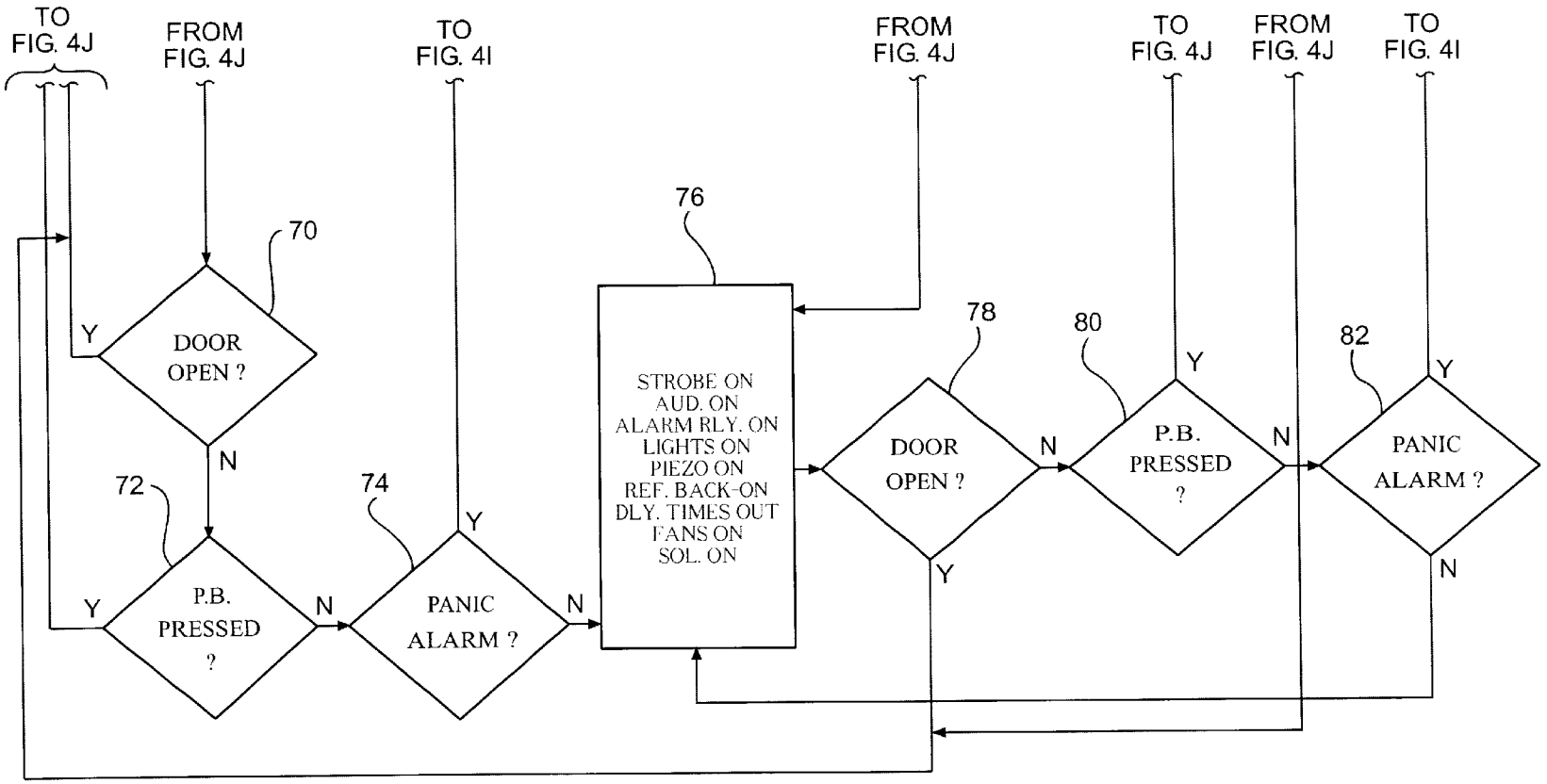

As with the relays, the audible alarm (26) and visual alarm (28) may be mounted remotely relative to the apparatus. However, in the preferred embodiment they are mounted on the front of the housing (11) of the apparatus as shown in FIG. 2. The entire apparatus will typically be mounted above the door of the compartment being monitored as this provides best access for connections of power, inputs and outputs, provides maximum effectiveness of audible and visual annunciation and offers maximum protection against physical damage to the apparatus.

FIGS. 3A–3D is a schematic diagram illustrating circuitry for the invention which is described as follows: Firstly, power for operation of the invention is supplied through terminals AC1 and AC2. Power is typically 120 VAC but other operating voltages may be utilized providing appropriate changes are made to certain power supply components. A varistor, VR1, is connected across AC1 and AC2 for the purpose of helping to prevent voltage spikes from causing damage to the circuitry. F1 is a ⅛ amp slow blow fuse, again provided to protect against circuit damage. T1 is a transformer which is utilized to step down the supply voltage to a level that is required for device operation. D1, D2, D3 and D4 are standard 1N4004 diodes configured into a full wave bridge rectifier for the purpose of converting the stepped down AC voltage from the transformer into DC voltage. C1 is a 1000 uf electrolytic capacitor which filters out AC ripple in the DC voltage. DC output at this point is approximately 17 VDC unregulated when unloaded by any of the output devices. This unregulated voltage is used to operate all of the output devices including the fan relay (RLYC1), the solenoid relay (RLY1), the light relay (RLYC2), the alarm relay (RLYB1), the audible alarm (horn, TS4), the peizo alarm (piezo) and the visual alarm (strobe TS5). The 17 VDC unregulated voltage is also used to provide power to illumination means inside of the Interior Compartment Switch (6). Power for illumination means is provided through R11, which is a 470 ohm current limiting resistor. Final power supply components are REG1, which is an LM7805, 5 volt regulator, and C2, a 220 uf. electrolytic capacitor which supplies additional filtering to the 5 VDC regulated output of REG1. This 5 VDC output is used to provide power to U1 which, in the preferred embodiment, is a microprocessor, part #PIC16C711 as manufactured by Microchip, and to U2A which is an exclusive OR gate, 7486.

The 5 VDC regulated output also supplies power for peripheral support components to U1, specifically S1P1, which is a 9 resistor sip package and is used as pull up resistors for the inputs of U1, R1, which is a 5K potentiometer used for adjusting the Alarm Delay (Audible Alarm Delay Adj. (8)) and R2, which a 5K potentiometer used for adjusting the Pre-delay, (Refrigeration Interruption Pre-Delay Adj. (10)). R10 is a padding resistor for R1, and R3 and R4 are protective resistors to help prevent noise from entering U1. C6 is a 0.1 uf capacitor placed directly across the power supplied to U1 for the purpose of providing additional noise filtering. C4 is a 0.1 uf capacitor that, in conjunction with a 4.7K resistor (SIP 1, Resistor 6), provides a reset signal for U1 whenever power is applied to the device. C5 is a 100 pf. capacitor that, in conjunction with a 4.7K resistor (SIP 1, Resistor 2), functions as part of the internal oscillator circuitry contained in U1. R8 is a 470 ohm resistor that is located between the door switch (Door Ajar switch, (4)) and U1. This resistor, in conjunction with TSB6 which is a transorb and C8 which is a 0.1 uf capacitor, form a filtering network to prevent unwanted noise from entering U1 through the wires leading from the door switch to U1. R9, TSB5 & C7 form an identical network on the input for the push button switch (Interior Compartment Switch) (6) for the same purpose.

DIP 1 is a Dip Switch containing four individual switches for selecting the following functions: Constant On Refrigeration (12); Fan Shutoff (14); Push Button Enable (16); and Alarm Relay Select (18). These switches may be used individually or in combination to select various modes of device operation when the compartment door is opened. The Constant On Refrigeration Switch (12), the Fan shutoff Switch (14) and the Push Button Enable Switch (16) are all connected directly to U1, as the functions that they address are all software based. The Alarm Relay Select Switch (18) is part of a hardware based function consisting of U2A (exclusive OR gate) and diodes D5 & D6 which function as an OR gate and, in conjunction with the Alarm Relay Select Switch (18) allow for selection of different modes of operation for the alarm relay. In the event that a microprocessor in a larger package with additional I/O's is utilized then this hardware functionality could easily be implemented in the software program of the microprocessor.

All outputs are driven by U2, a ULN2003, which is a 16 pin dip package containing 7 independent darlington transistors. C10, a 0.1 uf 600 V capacitor, and R5, a 150 ohm ½ watt resistor are connected in parallel across the normally closed contacts of RLYC1 as a snubber circuit to help protect relay contacts against pitting. Identical networks consisting of C9 and R6 across the normally closed contacts of RLYC1, and C11 and R7 across the normally open contacts of RLYC2 are part of the circuitry for these respective relays for the same purpose. All of the aforementioned circuitry and components are mounted onto a printed circuit board. This circuit board may be mounted separately from the audible alarm (26) and the visual alarm (28), but in the preferred embodiment, it is mounted inside of the enclosure as shown in FIG. 2.

FIGS. 4A–4K comprise a flow chart which illustrates the actual operating sequence of the invention. Prior to describing the flow chart however, it is necessary to clarify operation of the Fan Relay (20) and the Solenoid Relay (22). As disclosed in the previous description of the schematic diagram, both the Fan Relay (20) and the Solenoid Relay (22) have snubber circuitry across the normally closed contacts. This is because the normally closed contacts are the ones that are used for these two control functions. This configuration is desirable because a loss of power to the invention would not cause the termination of operation of the refrigeration system. In the aforementioned flow chart, the terms "Fans On" and "Sol. (solenoid) On" are used to describe actual operation of the refrigeration system. It is important to realize however, that, from the perspective of the logic of the circuitry, if "Fans On" is shown in the flow chart, the Fan Relay (20) itself that controls the fans is actually off so that the normally closed contacts can connect and make the fans operate. The same is true for the solenoid function. Additionally, the present invention is described as including a Solenoid Relay (22) for operating the solenoid valves of the refrigeration system. This is because most typical refrigeration systems of the type contemplated by the present invention include solenoid valves for regulating the flow of refrigerant or coolant through the system. For those systems that do not include solenoid valves but include some other form of valving to control flow of coolant such as an electronic expansion valve, the Solenoid Relay (22) of the present invention is simply a valve relay for operating the coolant valve of the system to regulate flow of the coolant.

Referring back to FIGS. 4A–4K to explain actual operation of the invention, operation is as follows. (Hereinafter, parenthesis which contain the letter B and a number refer to blocks on the flow chart.) Upon power up (B32), the device first checks the status of the door ajar switch (4) to determine if the door is opened or closed. If the door is closed, the strobe (28), the audible alarm (26) and the alarm relay (30) are off, the fans, the solenoid valve, the piezo alarm (7) and the interior lights are on and the 40 second lights-on timer is enabled (B36).

The lights-on timer is a non adjustable time delay that is internal to the processor (U1) and is incorporated as a safety feature and for energy conservation purposes. Its purpose is threefold: Firstly, whenever someone enters the compartment and closes the door, it insures that the lights will remain on for 40 seconds after the door is closed, providing ample time for user responses such as reopening the door, exiting the compartment, or pressing the interior compartment switch (6), which, if pressed, and as will be explained, will keep the lights on indefinitely until the door is reopened. Secondly, the lights-on timer activating on power up (B32) with the door closed insures that the lights will come on immediately when power is restored after a power failure. This is of particular importance in the event of a momentary power failure, which may occur when personnel are inside of the compartment. As before, it temporarily keeps lights on providing time for a response from the user. Thirdly, if no one is in the compartment and the lights on timer times out, the lights are shut off automatically to conserve energy. The piezo alarm (7) is annunciating at this time to make personnel who may be inside of the compartment aware of a pending condition that requires a user response. In this instance, the pending condition is that if the interior compartment switch (6) is not pressed within 40 seconds, the lights will turn off. Once the piezo alarm (7) draws attention to the interior compartment switch, then, in the preferred embodiment, a brief label placed adjacent to the interior compartment switch (6) instructs personnel as to device operation. The piezo alarm (7) may be configured to annunciate a constant tone or an intermittent tone. In the preferred embodiment the annunciation is to beep on and off intermittently.

Once the processor determines that the door is closed it then looks for one of three possible input conditions to occur, namely, the door opening (B38), the interior compartment switch to be momentarily pressed (B40) or the interior compartment switch to be pressed and held for two seconds which initiates a Panic Alarm (B42). The two second delay initiating the Panic Alarm function allows the interior compartment switch (6) to have two distinct and independent functions, normal momentary push button activation or a panic alarm, depending on how it is activated. If none of these input conditions occurs within 40 seconds, then the lights-on timer times out and the interior lights and the piezo alarm (7) turn off. All other conditions remain as before, namely, the strobe, the audible and the alarm relay are off and the fans and solenoid are on (B44). This then, (B44), is the normal operating condition of the monitored compartment when the door is to be closed for prolonged periods of time.

While the door is closed, the processor continues to look for door open (B46), PB pressed (B48) or panic alarm (B50) and if none of these conditions occurs it loops back to the aforementioned mode of operation and this occurs indefinitely until one of the three conditions is selected. For the sake of clarity, explanation of the sequence of operation when the door is opened or when a Panic Alarm is initiated will be temporarily bypassed in order to complete explanation of the remaining sequence of operation (PB Pressed) when the door is closed. Therefore, if the push button is pressed while the lights-on timer is timing out (B40), then the processor, while keeping the strobe, the audible and the alarm relay off, immediately turns off the fans and the solenoid, so that personnel who are inside of the compartment are not exposed to the refrigerated air blowing off of the evaporator coils. It also overrides the 40 second lights-on timer and turns the lights on constantly so that the lights will remain on indefinitely for as long as the door is closed. The piezo alarm (7) is also turned off. Additionally, the processor enables the 10 minute Check-in Delay Timer for reasons which will become apparent upon further disclosure of the flow chart.

The 10 minute Check-in Delay Timer is a non-adjustable timer that is internal to the processor and is only accessed by the Interior Compartment Switch (6) when the door is closed. All of these conditions are itemized in (B52). If the Interior Compartment Switch (6) is pressed (B48) after the lights-on timer has turned the lights off, then the processor will also go to Block 52 insuring that the lights will turn back on and remain on indefinitely for as long as the door is closed. The condition as described of pressing the Interior Compartment Switch (6) after the lights have turned off is what necessitates having the Interior Compartment Switch (6) illuminated. While unlikely, it is possible for a user to enter the compartment, close the door and fail to press the Interior Compartment Switch (6) before the lights on timer times out and shuts off the lights. If such a circumstance occurs, the illumination of the Interior Compartment Switch (6) makes it easier to locate the push button in a darkened compartment.

Once in the condition as described in Block 52, there are two possible user responses: either to open the door (B54) or to access the Panic Alarm (B56). Momentarily pressing the push button at this time will have no effect on device operation. Since explanation of operation when the door is open or when a panic alarm is initiated is being temporarily withheld it is assumed for purposes of explanation that neither of these actions have been taken. Therefore, in the absence of these actions the 10 minute check-in delay timer enabled in Block 52 times out and turns on the piezo alarm. (7)

Simultaneously, the 40 second Auto Panic Delay is enabled. The 40 second Auto Panic Delay is a non adjustable timer that is internal to the processor. All other conditions remain as in Block 52. This new condition is as shown in Block 58. The purpose of the piezo alarm (7) sounding is to annunciate to personnel inside of the compartment that a pending condition requiring a user response has been initiated and to prompt a response before the 40 second Auto Panic Timer times out and initiates the next level of alarm annunciation.

Once the piezo alarm (7) sounds, personnel have the option of opening the door (B60), momentarily pressing the Interior Compartment Switch (6) (B62) or initiating a Panic Alarm (B64). As before, since explanation of operation when the door is open or when a Panic Alarm is initiated is being temporarily withheld, it is assumed that neither of these actions have been taken. Therefore, this leaves PB pressed (B62) as the only decision to be made. If PB pressed (B62) is yes, then the processor maintains the strobe, the audible alarm, the alarm relay, the fans and the solenoid in an off condition, maintains the lights in an on condition, turns off the piezo alarm (7), resets the 40 second Auto Panic Delay and resets and re-enables the 10 minute Check-in Delay Timer (B66). From this point it loops back to the junction between Block 52 and Block 54 where the cycle begins again. This loop is repeatable for as many times as necessary and is used in situations where personnel may be in the compartment with the door closed for a prolonged period of time such as when doing inventory. It is desirable because it enables personnel to work inside of the compartment with the door closed so that there is no thermal exchange of inside and outside air thus saving energy. Additionally, it shuts the refrigeration off temporarily so that personnel are not exposed to the refrigerated air blowing off of the evaporator coil from the otherwise operating refrigeration system. Finally, it insures that lighting will remain on for the duration of time that they are in the compartment.

In the event that PB pressed is no (B62), and, assuming that Panic Alarm is no (B63), then the processor enters Auto Panic Alarm (B68). At this time, the piezo alarm (7) and the lights are on, the fans and the solenoid are off and the 40 second Auto Panic Delay times out turning on the strobe, the audible alarm and the alarm relay. Additionally, the 30 minute Refrigeration Back On Timer is enabled. The Refrigeration Back On Timer is a non adjustable delay that is internal to the processor. The purpose of the Auto Panic Alarm is to bring attention to personnel outside of the compartment that personnel inside of the compartment may have become disabled or injured and are unable to perform any of the three responses, namely, opening the door, momentarily pressing the push button or initiating the Panic Alarm. The purpose of activating the strobe, the audible alarm and the alarm relay at this time is to bring attention to the monitored condition. The strobe and the audible generate an on premise alarm and the alarm relay may be utilized to send an alarm signal to a remote location. The 30 minute refrigeration back on timer is provided as a protective measure against accidental interruption of refrigeration system operation.

All electronic devices may be subject to noise problems from sources such as voltage spikes on power lines or environmental disturbances such as lightning. While unlikely, it is possible that these noise problems could accidentally cause the aforementioned, push button function to be activated with the door closed even though the button had not been pressed. Additionally, it is possible for products inside of the compartment to accidentally fall and press the push button, which would create the same scenario. As will be explained upon further disclosure of the flow chart, the back on timer, upon timing out, automatically restarts the refrigeration in the event that either of these circumstances occurs so as to prevent a catastrophic loss of perishables.

Once in Auto Panic (B68), the user is again presented with the same three possible decisions of opening the door (B70), momentarily pressing the push button (B72) or initiating a Panic Alarm (B74). As before, since explanation of operation when the door is open or when a Panic Alarm is initiated is being temporarily withheld, it is assumed that neither of these actions have been taken. Therefore, this leaves PB pressed (B72) as the only decision to be made. If PB pressed (B72) is yes, then the processor loops back to Block 66 and then to the junction of Block 52 and Block 54 wherein the process starts again as previously described. As before, this process is repeatable for as many times as necessary. If PB pressed (B72) is no, then the processor goes to Block 76 where the back on timer times out and turns the fans and solenoid back on for reasons as described in the previous description of the purpose of the back on timer. Simultaneously, the strobe (28), the audible alarm (26), the alarm relay (30) the piezo alarm (7) and the lights all remain on as the possibility continues to exist that there may be personnel inside of the compartment. Since no additional timers are initiated, operation as described in Block 76 will continue while the processor looks for one of the same three possible responses of opening the door (B78), momentarily pressing the push button (B80) or initiating a Panic Alarm (B82). If none of these responses are made, the processor loops back to Block 76 and this continues indefinitely. If PB pressed (B80) is yes, then the processor loops back to Block 66 and then to the junction of B52 and B54 wherein the process starts again as previously described.

At this point, description of operation of the invention with the door closed and with either no response made by the user or with momentarily pressing the Interior Compartment Switch (6) at various times in the sequence of operation is complete. Therefore, the next function to be explained is the Panic Alarm function. The purpose of the Panic Alarm, also called an entrapment alarm, is to provide a means for personnel inside of the monitored compartment to manually activate the invention so that it will annunciate to personnel outside of the compartment that a condition exists whereby the door cannot be opened. This could be caused by a malfunctioning door or door latch, by merchandise which has inadvertently been placed in front of the door outside of the compartment, or could even be caused by lower air pressure inside of the compartment. This last scenario is particularly possible in freezers which are not properly vented or which may have a pressure relief vent blocked. If a freezer door is left opened for a period of time, air temperature inside of the compartment rises. Once the door is closed and the air starts to cool down inside of the compartment, a pressure imbalance results. Colder air takes up less volume and therefore, the warmer outside air puts pressure on the door making it more difficult to open, particularly if personnel inside of the walk-in are of smaller stature. Therefore, the presence of a Panic Alarm can have substantial benefit.

As previously described, the Panic Alarm function is accessed by pressing and holding the Interior Compartment Switch (6) for 2 seconds as opposed to initially or momentarily pressing it. The Panic Alarm may be activated at any time when the door is closed as indicated by the flow chart (Blocks 42, 50, 56, 64, 74 and 82). Regardless of where the processor is in its sequence of operation when the Panic Alarm function is accessed, the resultant operation is always the same. In Panic Alarm, the strobe (28), the audible alarm (26), the alarm relay (30) and the piezo alarm (7) are on, the lights are on, the fans and the coolant valve are off and the 30 minute refrigeration back on timer is enabled (Block 84). Once in Panic Alarm, the only operational choice that personnel have prior to the back on timer timing out concerns opening the door (B86). If the door is not opened before the back on timer times out, then the processor, while keeping the strobe on, the audible on, the alarm relay on, the piezo alarm (7) and the lights on, turns the fans and solenoid valve back on as well (Block 76). This is the same mode of operation that the processor goes to from the Auto Panic Alarm (B68) if no response is made when an Auto Panic Alarm occurs. From this point on, operation and intention of operation is identical to the previous disclosure related to the Auto Panic Alarm.

The final action that can be taken that relates to operation with the door closed that has not yet been disclosed is device operation when the door is opened. An examination of the flow chart as indicated on FIGS. 4A–4K shows that there are two different types of door open conditions that result in two different processor responses. The first door open condition involves opening of the door without first pressing the Interior Compartment Switch (6), either momentarily or as a Panic Alarm. This is a condition typically encountered when the door is opened after having been closed and there are no personnel inside of the compartment. This condition can be either within 40 seconds after the door has first been closed, whereby the 40 seconds lights on timer is still timing out and the lights are on as previously described (B36), (the following door open decision-yes (B38) is also as previously described.) or, it can be after the lights on timer has timed out and the lights have been turned off (B44), which, as previously disclosed, is the normal mode of operation when the compartment door is closed and there are no personnel inside. (The following door open decision (B46) is again, as previously described.) If either of these door open decisions is a yes, then the processor goes via letter B on FIGS. 4A–4K, to Door Closed-no (B34). This location in the flow chart is the same as where the processor would go if the door was opened when the device was first powered up (B32).

The second door open condition involves opening the door after the Compartment Switch (6) has been pressed either momentarily or for a Panic Alarm. As previously disclosed, this is a condition typically encountered when the door has been opened after having been closed and there are personnel inside of the compartment who have pressed the Interior Compartment Switch (6). Decision boxes relating to this condition and previously disclosed are Blocks 54, 60, 70, 78 and 86. For the sake of clarity, the sequence of operation when the door is opened after the Interior Compartment Switch (6) has been pressed will be temporarily withheld in order to describe the sequence of operation when the door is opened without first pressing the Interior Compartment Switch (6). As will be discussed, sequences of operation when the door is opened both before and after the Interior Compartment Switch (6) has been pressed ultimately become the same. When that point in the disclosure has been reached, both the functionality and the intent of the operating sequence of opening the door after the Interior Compartment Switch (6) has been pressed will be explained.

Therefore, as was previously disclosed, the sequence of operation is re-entered at Door Closed-no (B34). As previously stated, this is the monitored condition that is reached either when the door is opened when the device is first powered up (B32), or when the door is opened after having been closed and the Interior Compartment Switch (6) has not been pressed (Block 38 or 46). It is important to note that throughout the description of the remaining flow chart and sequence of operation, there are numerous decision boxes where the choice of closing the door can be made. Respectively, these are Blocks 34, 120, 124, 128, 132, 136, 140, 144, 148, 152, 156, 160, 168, 176, 184, 192, 200, 208, 216, 224, 232, 240 and 248. In all of these instances, Door Closed-yes goes via Letter A on FIGS. 4A–4K to (B36) wherein operation when the door is closed is initiated as previously described. This is referred to in the note in the lower left corner of FIG. 4F (B90).

Before proceeding further with the explanation of the flow chart it would be beneficial to explain the operation and intent of the switches and timer controls that are user selectable and that affect device operation when the door is opened. It is important to note that these various switches and timers have no effect on device operation when the door is closed.

The first control to be explained is the audible delay adjust. (8)(R1 on FIGS. 3A–3D.) This adjustment, in conjunction with a timer in the processor, provides a means for selecting the length of time desired from when the door is opened to when the audible sounds, indicating that a user response is required such as closing the compartment door. Many time delay ranges can be programmed, but in the preferred embodiment the time delay range is 2 to 60 minutes.

The second control to be explained is the refrigeration interruption pre-delay adjustment. (10) (R2 on FIGS. 3A–3D.) One possible and desired mode of operation of the invention is to shut off the fans and the solenoid valve, thus temporarily shutting off refrigeration whenever the door is opened. The benefit of this capability to the user is that it allows personnel to enter the compartment without being exposed to the dangerously cold air that would be blowing off of the evaporator coil if the refrigeration system were running. This is particularly true with walk-in freezers. However, it may not be desirable in all instances to have this occur every time that the door is opened. Therefore, this adjustment, in conjunction with a timer in the processor, provides the capability of delaying the shutting off of the fans and the solenoid valve for a user selected period of time relative to when the door is opened. This capability is of particular importance in food service applications where compartment doors may be opened and closed frequently for brief periods of time during periods of heavy usage such as preparing and serving lunch or dinner. The pre-delay function prevents repeatable interruption and restoration of operation of the fans and solenoid valve every time the door is opened and closed, thus minimizing wear on these devices as well as on other components of the refrigeration system such as the compressor. The pre-delay function also helps to maintain temperature in the compartment during times of frequent short time interval door usage by keeping the refrigeration system operational. Many time delay ranges for the pre-delay can be programmed, but in the preferred embodiment the time delay range is 1 to 120 seconds.

The third control to be explained is the Constant On Refrigeration Switch (12). When selected, this switch overrides any Refrigeration Interruption Pre-Delay Adjustment (10) and instead, keeps the fans and solenoid activated when the door is opened. As a result, operation of the refrigeration system with the door opened is not interrupted at all. Application for this feature is when it is desired to keep the refrigeration running when the door is open and yet still be able to have the refrigeration system interrupted as previously disclosed when the door is closed.

The fourth control to be explained is the Fan Shutoff Switch (14). When selected, this switch causes the fans to shut off immediately whenever the door is opened. Again, this is a capability for increasing user comfort as it allows personnel to enter the compartment without being exposed to the dangerously cold air blowing off of the evaporator coils.

The Fan Shutoff Switch (14), along with the Constant On Refrigeration Switch (12) and the Refrigeration Interruption Pre-Delay Adjustment (10) may be used in many different combinations to provide various modes of operation of the refrigeration system when the door is opened. For example, if neither of these switches is selected and the Refrigeration Interruption Pre-Delay Adjustment (10) is set for a 20 second delay, then the fans and solenoid valve will continue to run for 20 seconds after the door is opened before shutting off. If the door is closed before 20 seconds expires, fans and solenoid operation are not interrupted at all. If the Refrigeration Interruption Pre-Delay Adjustment (10) is set in the same way (20 second delay) and the fan switch (14) is selected, then the fans will turn off immediately when the door is opened but the solenoid will continue to respond to the Refrigeration Interruption Pre-Delay Adjustment (10) setting. In this setting, the fans will be shut off for user comfort, but the rest of the refrigeration system will remain operational for the length of the Refrigeration Interruption Pre-Delay Adjustment (10) setting. If the door is closed before 20 seconds expire, the fans will be turned back on and the rest of the refrigeration system operation will not be interrupted at all. If just the Constant On Refrigeration Switch (12) is selected, fans and solenoid will continue to run when the door is opened. If the Constant On Refrigeration Switch (12) and the Fan Shutoff Switch (14) are both selected then the fans will shut off immediately when the door is opened but the solenoid will remain on and the rest of the refrigeration system will continue to run. Therefore, this combination of switches and adjustments offers a wide variety of operational configurations of the refrigeration system relative to the status of the door being opened.

The fifth control to be explained is the Push Button Enable Switch (16). This switch effects operation of the Interior Compartment Switch (6) when the door is opened. As will be disclosed, the Interior Compartment Switch (6) does not affect device operation in any way when the door is opened until the audible delay timer times out and the audible begins to sound. Selection of the Push Button Enable Switch (16) determines if the Interior Compartment Switch (6) will affect device operation from this point on in the operating sequence. If the Push Button Enable Switch (16) is selected and the audible starts to sound, then pressing the Interior Compartment Switch (6) will cause certain reset functions such as silencing the audible alarm and resetting and restarting the Audible Alarm Delay Timer. This capability is useful in situations where a door is to be opened for a prolonged period of time such as loading or unloading of the compartment as it provides a means for resetting the invention without having to close the door. If the Push Button Enable Switch (16) is not selected, then the Interior Compartment Switch (6) has no effect whatsoever, on device operation when the door is opened. This configuration is selected if it is desired to have closing of the door as the only way to silence and reset the outputs of the invention.

The sixth control to be explained is the Alarm Relay Select Switch (18). Of these six controls, this is the only feature that is not a part of the program that is contained in the microprocessor. Rather, this switch is part of an external OR gate including diodes D5 and D6 (FIGS. 3A–3D) and its purpose is to select when the Alarm Relay (30) is to be activated relative to the status of the door. If this switch is selected, then the Alarm Relay (30) activates immediately when the door is opened and remains activated until the door is closed. An application for this configuration would be if the Alarm Relay (30) is connected to a computerized control or monitoring system that is configured to receive a signal every time that the door is opened. If the Alarm Relay Select Switch (18) is not selected, then Alarm Relay (30) activation is delayed until an actual alarm condition occurs. An application for this configuration would be if the Alarm Relay (30) is connected to a remote monitoring system whereby it is desired to only receive a signal if an actual alarm condition exists.

There are three different types of alarm conditions that are generated by the invention: a Panic Alarm, an Auto Panic Alarm and a Door Ajar Alarm. For a Panic Alarm, as previously disclosed, an actual alarm condition with Alarm Relay (30) activation occurs immediately when the Panic Alarm is initiated, regardless of the position of the Alarm Relay Select Switch (18). For an Auto Panic Alarm, also as previously disclosed, an actual alarm condition with Alarm Relay (30) activation occurs 40 seconds after the Piezo Alarm (7) begins to annunciate if there has been no response from the user, again, regardless of the position of the Alarm Relay Select Switch (18). This sequence is desirable because the Piezo Alarm (7) first serves as a local notification to the user that a response is required, and the Alarm Relay (30), along with the visual alarm and the audible alarm, is only activated if there is no user response, indicating that an actual alarm condition exists. Therefore, this sequence of operation eliminates remote "nuisance alarms". For a Door Ajar Alarm, as will be disclosed, when the Alarm Relay Switch (18) is not selected, the sequence and intent of the operation of the Alarm Relay (30) is identical to the Auto Panic Alarm, only, in this instance, and as will be disclosed, relative to the Audible Alarm and piezo alarm annunciation.

This then, is a complete listing of all of the controls and adjustments that can be pre-configured to determine operation of the invention when the door is open. Therefore, returning to the sequence of operation, if the processor is at Door Closed-no (B34), the processor then looks sequentially at the Constant On Refrigeration Switch (12) and the Fan Shutoff Switch (14) to determine the operating sequence. The Alarm Relay Select Switch (18) is also represented on the flow chart, but as previously indicated, is not a software function, and therefore, is not looked at by the processor. Nevertheless, the mode of its selection causes a variation in overall device operation that is represented in the flow chart. Also, as previously indicated, the Push Button Enable Switch (10) has no bearing on device operation at this time. Therefore, from looking at the Constant On Refrigeration Switch (12), the Fan Shutoff Switch (14) and the Alarm Relay Select Switch (18), their are 8 different possible sequences of operation, described as follows:

1) If Constant On Refrigeration (B88) is No, Fan Shutoff (B92) is No and Alarm Relay Select (B94) is No, then the resulting configuration is: Strobe on, Audible off, Piezo off, Alarm Relay off, Lights on, Fans on, Solenoid on, Refrigeration Shutoff Pre-Delay enabled, Audible Delay enabled (B96).
2) If Constant On Refrigeration (B88) is No, Fan Shutoff (B92) is No and Alarm Relay Select (B94) is Yes, then the resulting configuration is: Strobe on, Audible off, Piezo off, Alarm Relay on, Lights on, Fans on, Solenoid On, Refrigeration Shutoff Pre-Delay enabled, Audible Delay enabled (B98).

3) If Constant On Refrigeration (B88) is No, Fan Shutoff (B92) is Yes and Alarm Relay Select (100) is No, then the resulting configuration is: Strobe on, Audible off, Piezo off, Alarm Relay off, Lights on, Fans off, Solenoid on, Refrigeration Shutoff Pre-Delay enabled, Audible Delay enabled (102).
4) If Constant On Refrigeration (B88) is No, Fan Shutoff (B92) is Yes and Alarm Relay Select (100) is Yes, then the resulting configuration is: Strobe on, Audible off, Piezo Off, Alarm Relay on, Lights on, Fans off, Solenoid on, Refrigeration Shutoff Pre-Delay enabled, Audible Delay enabled (104).
5) If Constant On Refrigeration (B88) is Yes, Fan Shutoff (B106) is No, and Alarm Relay Select (B108) is No, then the resulting configuration is: Strobe on, Audible off, Piezo off, Alarm Relay off, Lights on, Fans on, Solenoid on, 10 Minute Check-in Delay reset, Audible Delay enabled (B110).
6) If Constant On Refrigeration (B88) is Yes, Fan Shutoff (B106) is No, and Alarm Relay Select (B108) is Yes, then the resulting configuration is: Strobe on, Audible off, Piezo off, Alarm Relay on, Lights on, Fans on, Solenoid on, 10 Minute Check-in Delay reset, Audible Delay enabled (B112).
7) If Constant On Refrigeration (B88) is Yes, Fan Shutoff (B106) is Yes, and Alarm Relay Select (B114) is No, then the resulting configuration is: Strobe on, Audible off, Piezo off, Alarm Relay off, Lights on, Fans off, Solenoid on, 10 Minute Check-in Delay reset, Audible Delay enabled (B116).
8) If Constant On Refrigeration (B88) is Yes, Fan Shutoff (B106) is Yes, and Alarm Relay Select (B114) is Yes, then the resulting configuration is: Strobe on, Audible off, Piezo off, Alarm Relay on, Lights on, Fans off, Solenoid on, 10 Minute Check-in Delay reset, Audible Delay enabled (B118).

It is apparent upon reviewing the disclosure to this point that, in the preferred embodiment, the Visual Alarm (Strobe) is always on when the door is opened to provide immediate visual annunciation of the door opened condition, the lights are always on when the door is opened to provide illumination means inside of the compartment, and the Audible and the Piezo are always off when the door is opened as they always responds to the Audible Timer timing out before turning on. It is noteworthy to mention that, if so desired, the standard connection to the strobe need not be made and the strobe can instead be connected in parallel with the audible alarm. When so connected as an alternate configuration, the strobe will not turn on when the door opens, but will instead turn on when the audible alarm annunciates. All other parameters are variable in accordance with the settings of the previously described controls.

From the point of each of the eight previously disclosed operational configurations, the processor then looks again to see if the door is closed or remains opened. As previously described, any door closed condition, as sensed by the Door Ajar Switch (4), causes the processor to go to Block 36 for the door closed sequence of operation. If the door is not closed, the eight resulting sequences of operation are:

1) From Block 96, if Door Closed is No (B120): Strobe on, Audible off, Piezo off, Alarm Relay off, Lights on, Refrigeration Shutoff Pre-Delay times out and turns Fans and Solenoid off (B122).
2) From Block 98, if Door Closed is No (B124): Strobe on, Audible off, Piezo off, Alarm Relay on, Lights on, Refrigeration Shutoff Pre-Delay times out and turns Fans and Solenoid off (B126).
3) From Block 102, if Door Closed is No (B128): Strobe on, Audible off, Piezo off, Alarm Relay off, Lights on, Fans off, Refrigeration Shutoff Pre-Delay times out and turns Solenoid off (B130).
4) From Block 104, if Door Closed is No (B132): Strobe on, Audible off, Piezo off, Alarm Relay on, Lights on, Fans off, Refrigeration Shutoff Pre-Delay times out and turns Solenoid off (B134).
5) From Block 110, if Door Closed is No (B136): Strobe on, Alarm Relay off, Lights on, Fans on, Solenoid on, Audible Delay times out and turns Audible and Piezo on, 40 second Auto Restart Delay enabled (B138).
6) From Block 112, if Door Closed is No (B140): Strobe on, Alarm Relay on, Lights on, Fans on, Solenoid on, Audible Delay times out and turns Audible and Piezo on, 40 second Auto Restart Delay enabled (B142).
7) From Block 116, if Door Closed is No (B144): Strobe on, Alarm Relay off, Lights on, Fans off, Solenoid on, Audible Delay times out and turns Audible and Piezo on, 40 second Auto Restart Delay enabled (B146).
8) From Block 118, if Door Closed is No (B148): Strobe on, Alarm Relay on, Lights on, Fans off, Solenoid on, Audible Delay times out and turns Audible and Piezo on, 40 second Auto Restart Delay enabled (B150).

It is important to note that Blocks 122, 126, 130 and 134 represent an additional step in the sequence of operation that occurs when Constant On Refrigeration (B88) is No (not selected). This is due to the fact that if Constant On Refrigeration (B88) is No, then the Refrigeration Shutoff Pre-Delay Timer, as previously disclosed, is included in the sequence of operation and Blocks 122, 126, 130 and 134 represent the status of operation when the Refrigeration shutoff Pre-Delay times out. It is also important to note that at this point, the status of operation of Blocks 122 and 130 are identical to each other, as are their following sequences of operation, and that the status of Blocks 126 and 134 are also identical to each other as are their following sequences of operation. Therefore, explanation of the sequence of operation following Blocks 122 and 130 can be made congruently, and likewise, explanation of the sequence of operation following Blocks 126 and 134 can also be made congruently. Because of the aforementioned additional step caused by the presence of the Refrigeration Shutoff Pre-Delay Timer, the processor, in these two resulting sequences of operation looks again to see if the door is closed or remains opened. If the door is not closed, the operating sequences are:

1) From Blocks 122 and 130, if Door Closed (B152) is No: Strobe on, Alarm Relay off, Lights on, Fans off, Solenoid off, Audible Delay times out and turns Audible and Piezo on, 40 second Auto Restart Delay is enabled (B154).
2) From Blocks 126 and 134, if Door Closed (B158) is No: Strobe on, Alarm Relay on, Lights on, Fans off, Solenoid off, Audible Delay times out and turns Audible and Piezo on, 40 second Auto Restart Delay is enabled (B158).

At this point, all six remaining operating variations, (the two as previously described) and the four that result from Constant On Refrigeration (B88) is Yes, are at the same point in the sequence of operation in that the Audible Delay has timed out turning on the Audible Alarm and the Piezo Alarm and the Auto Restart Delay Timer has been enabled. Both the Audible Alarm and the Piezo Alarm are activated when the Audible Delay times out as personnel to be notified may be inside or outside of the compartment when the annunciation occurs. The Auto Restart Delay Timer is the final time delay in the sequence of operation when the door is opened. Activation of the Auto Resart Delay Timer is initiated by the timing out of the Audible Alarm Delay Timer. Therefore, the Auto Restart Delay Timer is linked to, and, as, a result, is dependent upon and integrated with the Audible Delay Timer timing out and the resultant Audible Alarm and Piezo Alarm activation.

The Auto Restart Delay is internal to the processor, and, in the preferred embodiment, is a non-user adjustable fixed time of approximately 40 seconds in duration. The Auto Restart Delay Timer has two purposes: Firstly, it gives personnel who may be present when the Audible Alarm and Piezo Alarm occurs, time to respond before the next events in the sequence of operation are initiated. The user responses are to either close the door, or, if the Push Button Enable Switch (16) is selected, to press the Interior Compartment Switch (6). Secondly, if neither of these user responses is performed before the Auto Restart Delay times out, then the timing out of the Auto Restart Delay initiates the final device operations. Such an occurrence may happen when personnel are not present to respond when the Audible Alarm and Piezo Alarm sounds and the compartment door has actually been left opened or ajar. At this time, the Strobe Light is always turned off as a conservation measure in order to prolong the life of the Strobe Light. Simultaneously, the Fans and the Solenoid, if not on already as determined by the position of the Constant On Refrigeration Switch (12) will also always be turned on at this time so that the refrigeration system will attempt to maintain compartment temperature even though the door is opened. The Alarm Relay (30), if not on already as determined by the position of the Alarm Relay Select Switch (18) is turned on as well to send a signal remotely if so connected. The Audible Alarm (26) and the Piezo Alarm (7) will continue to sound to draw attention to the door ajar condition and the lights will remain on inside of the compartment for as long as the door is opened.

With this understanding of the function and intent of the Auto Restart Delay Timer, attention can now be returned to the sequence of operation as disclosed in the flow chart. As previously described, their are now six different variations of operating conditions that the invention can be in at this time, each of which is determined by the various selections made on the Constant On Refrigeration Switch (12), the Fan Shutoff Switch (14) and the Alarm Relay Select Switch (18). From this point on, the sequence of operation for all six variations is identical. However, the resultant operating conditions for each will be slightly different, again, depending on the selected combination of the aforementioned three switches. Therefore, the first of the six variations to be explained is the sequence from Block 154.

Once in Block 154, the processor again looks to see if the door is closed. If Door Closed B160 is No, then the processor looks to see if the Interior Compartment Switch (6) is pressed. If PB Pressed (B162) is No, then the Auto Restart Delay times out and the operating conditions are: Strobe off, Audible on, Piezo on, Alarm Relay on, Lights on, Fans on and Solenoid on (B164). If PB Pressed (B162) is yes, then the processor looks to see if the Push Button Enable Switch (16) is selected. If PB Enable (B166) is No, then the operating condition again goes to Block 164. From Block 164, the processor again looks to see if the door is closed. If Door Closed (B168) is No, the processor again looks to see if the Interior Compartment Switch (6) is pressed. If PB Pressed (B170) is No, the processor loops back to Block 164. If PB Pressed (B170) is Yes, the processor looks at the PB Enable Switch (16). If PB Enable (B172) is No, the processor loops back to Block 164. If PB Enable (B172) is Yes, then the operating conditions are: Strobe on, Audible off, Piezo off, Alarm Relay Off, Lights on, Fans off, Solenoid off, and Audible Delay Timer reset and re-enabled (B174). Block 174 is also reached if PB Enable (B166) is Yes. From Block 174, the processor loops back to the junction between Blocks 122 and 152 and the procedure begins again. If the Push Button Enable Switch (16) is selected, this loop may be repeated indefinitely by pressing the Interior Compartment Switch (6) either before or after Block 164. This is useful in circumstances where the door may be opened for prolonged periods of time such as when product is being loaded or unloaded. If the Interior Compartment Switch (6) is not pressed or the door is not closed, the operating condition of Block 164 will remain indefinitely. If the door is closed at any time, the processor will loop back to Block 36.

Since, as previously, disclosed, the sequence of operation is identical for all six variations, an abbreviated version is presented for the remaining five variations:

From Block 158, if Door Closed (B176) is No, PB Pressed (B178) is No, operating conditions are: Audible on, Piezo on, Alarm relay on, Lights on, Auto Restart Delay times out and turns Strobe off, Fans on and Solenoid on (B180). If (B178) is yes, PB Enable (B182) is No, processor goes to (B180). From (B180), if Door Closed (B184) is No, PB Pressed (B186) is No, processor goes to (B180). If PB Pressed (B186) is Yes, PB Enable (B188) is No, processor goes to (B180). If PB Enable (B188) is Yes, operating conditions are: Strobe on, Audible off, Piezo off, Alarm Relay on, Lights on, Fans off, Solenoid off, Audible Delay reset and re-enabled (B190). If (B182) is Yes, processor also goes to (B190). Block 190 loops back to the junction of (B134) and (B156).

From Block 138, if Door Closed (B208) is No, PB Pressed B210) is No, operating conditions are: Audible on, Piezo on, Lights on, Fans On, Solenoid On, Auto Restart Delay times out and turns Strobe off and Alarm Relay on(B212). If (B210) is yes, PB Enable (B214) is No, processor goes to (B212). From (B212), if Door Closed (216) is No, PB Pressed (B218) is No, processor goes to (B212). If PB Pressed (B218) is Yes, PB Enable (B220) is No, processor goes to (B212). If PB Enable (B220) is Yes, operating conditions are: Strobe on, Audible off, Piezo off, Alarm Relay off, Lights on, Fans on, Solenoid on, Audible Delay reset and re-enabled (B222). If (B214) is Yes, processor also goes to (B222). Block 222 loops back to the junction of (B110) and (B136).

From Block 142, if Door Closed (B192) is No, PB Pressed (B194) is No, operating conditions are: Audible on, Piezo on, Alarm relay on, Lights on, Fans on, Solenoid on, Auto Restart Delay times out and turns Strobe off (B196). If (B194) is yes, PB Enable (B198) is No, processor goes to (B196). From (B196), if Door Closed (B200) is No, PB Pressed (B202) is No, processor goes to (B196). If PB Pressed (B202) is Yes, PB Enable (B204) is No, processor goes to (B196). If PB Enable (B204) is Yes, operating conditions are: Strobe on, Audible off, Piezo off, Alarm Relay on, Lights on, Fans on, Solenoid on, Audible Delay reset and re-enabled (B206). If (B198) is Yes, processor also goes to (B206). Block 206 loops back to the junction of (B112) and (B140).

From Block 146, if Door Closed (B240) is No, PB Pressed (B242) is No, operating conditions are: Audible on, Piezo on, Lights on, Solenoid on, Auto Restart Delay times out and turns Strobe off, Alarm Relay on and Fans on (B244). If (B242) is yes, PB Enable (B246) is No, processor goes to (B244). From (B244), if Door Closed (B248) is No, PB Pressed (B250) is No, processor goes to (B244). If PB Pressed (B250) is Yes, PB Enable (B252) is No, processor goes to (B244). If PB Enable (B252) is Yes, operating conditions are: Strobe on, Audible off, Piezo off, Alarm Relay off, Lights on, Fans off, Solenoid on, Audible Delay reset and re-enabled (B254). If (B246) is Yes, processor also goes to (B254). Block 254 loops back to the junction of (B116) and (B144).

From Block 150, if Door Closed (B224) is No, PB Pressed (B226) is No, operating conditions are: Audible on, Piezo on, Alarm relay on, Lights on, Solenoid on, Auto Restart Delay times out and turns Strobe off and Fans on (B228). If (B226) is yes, PB Enable (B230) is No, processor goes to (B228). From (B228), if Door Closed (B232) is No, PB Pressed (B234) is No, processor goes to (B228). If PB Pressed (B234) is Yes, PB Enable (B236) is No, processor goes to (B228). If PB Enable (B236) is Yes, operating conditions are: Strobe on, Audible off, Piezo off, Alarm Relay on, Lights on, Fans off, Solenoid on, Audible Delay reset and re-enabled (B238). If (B230) is Yes, processor also goes to (B238). Block 238 loops back to the junction of (B118) and (B148).

This then is the complete explanation of device operation when the door is opened, in accordance with the flow chart. The only conditions that remain to be disclosed have to do with the sequences of operation that occur when someone enters the compartment, closes the door, presses the Interior Compartment Switch (6), and re-opens the door. From looking at FIGS. 4A–4K of the flow chart it is apparent that their are numerous Door Open decision blocks that occur in the sequence of operation after the Interior Compartment Switch (6) has been pressed, either momentarily or as a Panic Alarm. These blocks are Blocks 54, 60, 70, 78 and 86. If the door is opened from any of these decision blocks, the processor first looks at the Constant On Refrigeration Switch (12). If Constant On Refrigeration (B256) is yes, then the processor, via C on FIGS. 4A–4K goes to the junction between (B88) and (B106). Operation will then be in accordance with the previous disclosure of the flow chart when entered at this point. If Constant On Refrigeration (B256) is No, then the Alarm Relay Select Switch (18), while not looked at by the processor, will be the next decision to determine the sequence of operation that follows. If Alarm Relay Select (B258) is No, then operating conditions are: Strobe on, Audible off, Piezo off, Alarm Relay Off, Lights on, Fans off, Solenoid off, 10 Minute Check-in Delay reset and Audible Delay enabled (B260). Then, the processor, via E on FIGS. 4A–4K goes to the junction between (B122) and (B152). Operation will then be in accordance with the previous disclosure of the flow chart when entered at this point. If Alarm Relay Select (B258) is Yes, then operating conditions are: Strobe on, Audible off, Piezo off, Alarm Relay on, Lights on, Fans off, Solenoid off, 10 Minute Check-in Delay reset and Audible Delay enabled (B262). Then, the processor, via D on FIGS. 4A–4K goes to the junction between (B134) and (B156). Operation will then be in accordance with the previous disclosure of the flow chart when entered at this point.

The reason for this configuration is as follows: Firstly, if the Constant On Refrigeration Switch (12) is selected, it is because it is the intention of the installer to have the refrigeration system on when the door is opened. As previously disclosed, pressing the Interior Compartment Switch (6) with the door closed turns off the refrigeration. Therefore, this configuration insures that the refrigeration will turn back on when the door is re-opened. Secondly, if the Interior Compartment Switch (6) is not selected, it is because it is the intention of the installer to have the refrigeration system turn off when the door is opened, which will happen after the Refrigeration Shutoff Pre-Delay Timer times out. Again, as previously disclosed, pressing the Interior Compartment Switch (6) with the door closed turns off the refrigeration. It is possible that an installer may have relatively short time delays of 1 to 20 seconds selected on the Refrigeration Shutoff Pre-Delay Adjustment (10). Therefore, in order to prevent refrigeration from turning on when the door is opened and then turning off again when the Refrigeration Shutoff Pre-Delay times out, it is more desirable to bypass the pre-delay so that this does not occur. This configuration minimizes wear on the refrigeration system.

This then, completes the description of the entire sequence of operation of the invention. In all of these various operational sequences, an important concept that is present throughout is functional integration. This is the case not only for the invention itself but also for the compartment upon which it is installed. By monitoring the door, status of the door being opened or closed is integrated with operation of the refrigeration system as well as with operation of interior lights. The two input sensors are integrated in that both work in conjunction with each other in activating or de-activating device functions. At times, the Door Ajar Switch (4) overrides the Interior Compartment Switch (6) and at other times, depending upon the mode of operation, the opposite is true. Additionally, operational sequences successfully integrate activation of control functions and Panic Alarm functions into the Interior Compartment Switch (6) making this single switch a multi-functional input device depending on how and when it is used. The auto restart of refrigeration in a door ajar alarm is integrated with the activation of the Audible Alarm (26) and the Piezo Alarm (7) so that the Audible Alarm (26) and the Piezo Alarm (7) can warn of a pending restoration of operation of the refrigeration system. The same is true of the Piezo Alarm (7) in providing warning of the Lights on Timer turning the lights off or of a pending Auto Panic Alarm. This functional integration creates a device that, while simple to install and use, is highly effective in performing the numerous tasks for which it is intended.

Variations on device capabilities could expand the concept of functional integration still further. One possibility would be to incorporate a temperature alarm capability into the apparatus. It would be a relatively simple matter to integrate a remote temperature sensor such as a thermistor into the device, provide a means for establishing and setting high and low temperature limits for safe operation and incorporating an adjustable time delay function to override normal rises in compartment temperature such as those caused by defrost cycles. The existing annunciation system could be utilized to annunciate a prolonged abnormal temperature condition that would warrant corrective action being taken. If desired, a digital readout could be provided as a means of displaying compartment temperature, temperature set points, alarm delay times and other parameter adjustments. This additional functionality can be accomplished using discrete components but would be more effectively implemented in a micro-controller design that would include the necessary analog to digital converters and device drivers needed to provide this functionality.

In this variation it would also be possible to integrate the temperature sensing function with the door ajar function in an operational matter. For example, means could be provided for establishing temperature limits that are different from alarm limits so that normal interruption of operation of the refrigeration system functions as selected by the dual input sensing means would be overridden and thus would not occur if the compartment was too warm. This would give the refrigeration system the opportunity to bring the compartment temperature back down to a safe level at which point normal interruption of operation of the refrigeration system function would be re-enabled.

Taking this concept of functional integration still further, other capabilities could be included such as actual control of compartment temperature, initiation and termination of defrost cycles and the like, making the apparatus into a true control of compartment operation as well as incorporating all of the other aforementioned functionality. Separate relays for fans and solenoid control are already in place and it would be relatively easy to provide outputs for other functions such as defrost operations. Once in the realm of micro-controller design, data logging functions could be implemented for recording temperatures and various operational or alarm conditions and it would even be possible to provide appropriate interfaces for communication with other devices such as computers or building automation systems whereby the apparatus could transmit data regarding compartment operation or receive data regarding proper set up so that it could be configured from a remote location.

Additionally, because of the many different functions performed by the invention, it would be possible to separate out some of the functions to create a device for which application could exist beyond being utilized in refrigerated compartments. For example, if functions relating to fan and solenoid operation were deleted, the remaining functionality would comprise a light switch that would activate and deactivate in accordance with the previous disclosure and would be effective for controlling illumination means in other types of compartments such as storerooms.

The actual computer source code in accordance with the present invention is provided herewith in the annexed Appendix and is incorporated herein as part of the disclosure of the invention.

While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the claims.

What is claimed is:

1. An apparatus for monitoring, indicating and controlling conditions of a refrigeration system having a refrigerated compartment, a door for accessing the refrigerated compartment, an interior light source for illuminating the interior of the compartment and a fan and coolant valve arrangement for refrigerating the compartment comprising:

a door switch for detecting an open or closed condition of the door to the refrigerated compartment;

a light relay for providing power to the interior light source of the compartment in an activated state and for terminating power to the light source in a deactivated state; and a microprocessor electrically connected with said door switch and said light relay for activating said light relay when said door switch detects a door open condition, said microprocessor including an interior light timing algorithm for deactivating said light relay after a predetermined delay when said door switch detects a door closed condition.

2. The apparatus as defined in claim 1, further comprising an audible alarm electrically connected to said microprocessor, wherein said microprocessor activates said audible alarm when said interior light timing algorithm is enabled.

3. The apparatus as defined in claim 1, further comprising an audible alarm electrically connected to said microprocessor and wherein said microprocessor further includes an alarm timing algorithm for activating said audible alarm after a predetermined delay when said door switch detects a door open position.

4. The apparatus as defined in claim 1, further comprising a visual alarm electrically connected to said microprocessor, said microprocessor activating said visual alarm when said door switch detects a door open position.

5. The apparatus as defined in claim 1, further comprising:

a fan relay electrically connected to said microprocessor for providing power to at least one fan of the refrigeration system in a deactivated state and for terminating power to the at least one fan in an activated state; and a valve relay electrically connected to said microprocessor for providing power to the coolant valve of the refrigeration system in a deactivated state and for terminating power to the coolant valve in an activated state.

6. The apparatus as defined in claim 5, wherein said microprocessor includes a user selectable switch positionable to a selected position, wherein when said switch is in said selected position, said microprocessor activates said fan relay and said valve relay when said door switch detects a door open position.

7. The apparatus as defined in claim 6, wherein said microprocessor includes a refrigeration timing algorithmn for activating said fan relay and said valve relay after a predetermined delay when said door switch detects a door open position.

8. The apparatus as defined in claim 6, wherein said microprocessor includes a refrigeration timing algorithm for deactivating said fan relay and said valve relay after a predetermined delay.

9. The apparatus as defined in claim 5, wherein said microprocessor includes a user selectable switch positionable to a selected position, wherein when said switch is in said selected position, said microprocessor activates only said fan relay when said door switch detects a door open position.

10. The apparatus as defined in claim 9, wherein said microprocessor includes a refrigeration timing algorithm for activating said valve relay after a predetermined delay when said door switch detects a door open position.

11. The apparatus as defined in claim 9, wherein said microprocessor includes a refrigeration timing algorithm for deactivating said fan relay after a predetermined delay.

12. The apparatus as defined in claim 10, wherein said microprocessor includes a refrigeration timing algorithm for deactivating said valve relay after a predetermined delay.

13. The apparatus as defined in claim 5, wherein said microprocessor includes a user selectable switch positionable to a selected position, wherein when said switch is in said selected position, said microprocessor maintains said fan relay and said valve relay in a deactivated state when said door switch detects a door open position.

14. The apparatus as defined in claim 5, wherein said microprocessor includes a user selectable switch positionable to a selected position, wherein when said switch is in said selected position, said microprocessor activates said fan relay while maintaining said valve relay in a deactivated state when said door switch detects a door open position.

15. The apparatus as defined in claim 14, wherein said microprocessor includes a refrigeration timing algorithm for deactivating said activated fan relay after a predetermined delay.

16. The apparatus as defined in claim 5, further comprising an audible alarm electrically connected to said microprocessor and wherein said microprocessor further includes an alarm timing algorithm for activating said audible alarm after a predetermined delay when said door switch detects a door open position and a refrigeration timing algorithm for activating said fan relay and said valve relay after a predetermined delay when said audible alarm is activated.

17. The apparatus as defined in claim 1, further comprising a manually depressible push button electrically connected to said microprocessor, said push button being located within said refrigerated compartment for manually activating said light relay when initially depressed when said door switch detects a door closed condition.

18. The apparatus as defined in claim 5, further comprising a manually depressible push button electrically connected to said microprocessor, said push button being located within said refrigerated compartment for manually activating said fan relay and said valve relay when initially depressed when said door switch detects a door closed condition.

19. The apparatus as defined in claim 3, further comprising a manually depressible push button electrically connected to said microprocessor, said push button being located within said refrigerated compartment and wherein said alarm timing algorithm activates said audible alarm after a predetermined delay from when said push button is initially depressed when said door switch detects a door closed condition.

20. The apparatus as defined in claim 19, wherein said microprocessor deactivates said audible alarm when said push button is initially depressed.

21. The apparatus as defined in claim 19, wherein said alarm timing algorithmn of said microprocessor is reset when said push button is initially depressed.

22. The apparatus as defined in claim 19, further comprising a visual alarm electrically connected to said microprocessor and wherein said alarm timing algorithm activates said visual alarm after a predetermined delay from when said audible alarm is activated when said door switch detects a door closed condition.

23. The apparatus as defined in claim 21, wherein said alarm timing algorithm of said microprocessor is reset when said push button is initially depressed.

24. The apparatus as defined in claim 5, further comprising:

an audible alarm electrically connected to said microprocessor;

a visual alarm electrically connected to said microprocessor; and a manually depressible push button electrically connected to said microprocessor, said push button being located within said refrigerated compartment for manually activating said audible alarm, said visual alarm, said fan relay and said valve relay when depressed for a predetermined period of time when said door switch detects a door closed condition.

25. The apparatus as defined in claim 24, wherein said microprocessor further includes a back-on timing algorithm for deactivating said fan relay and said valve relay after a predetermined delay from when said push button is depressed for a predetermined period of time when said door switch detects a door closed condition.

26. The apparatus as defined in claim 18, further comprising:

an audible alarm electrically connected to said microprocessor; and a visual alarm electrically connected to said microprocessor, wherein said microprocessor includes an alarm timing algorithm for activating said audible alarm and said visual alarm after a predetermined delay from when said push button is initially depressed when said door switch detects a door closed condition.

27. The apparatus as defined in claim 26, wherein said microprocessor further includes a back-on timing algorithm for deactivating said fan relay and said valve relay after a predetermined delay from when said push button is initially depressed when said door switch detects a door closed condition.

* * * * *